US007392005B2

(12) United States Patent
Kaji et al.

(10) Patent No.: US 7,392,005 B2
(45) Date of Patent: Jun. 24, 2008

(54) IMAGE HEATING APPARATUS

(75) Inventors: Keigo Kaji, Abiko (JP); Hiroshi Komiyama, Kashiwa (JP); Daigo Matsuura, Toride (JP); Makoto Jinzai, Abiko (JP); Yasuhiro Hayashi, Moriya (JP); Kazuhiro Hasegawa, Toride (JP); Shigeaki Takada, Kashiwa (JP); Nobuaki Hara, Abiko (JP); Ikuo Nakamoto, Toride (JP); Shinichiro Hosoi, Kashiwa (JP); Seiichiro Kameda, Abiko (JP); Junichi Moteki, Abiko (JP); Youichi Chikugo, Toride (JP); Yoshikuni Ito, Tokyo (JP)

(73) Assignee: Canon Kabushiki Kaisha

( * ) Notice: Subject to any disclaimer, the term of this patent is extended or adjusted under 35 U.S.C. 154(b) by 0 days.

(21) Appl. No.: 11/530,769

(22) Filed: Sep. 11, 2006

(65) Prior Publication Data

US 2007/0071522 A1 Mar. 29, 2007

(30) Foreign Application Priority Data

Sep. 13, 2005 (JP) ..... 2005-265519
Sep. 13, 2005 (JP) ..... 2005-266009

(51) Int. Cl.
*G03G 15/20* (2006.01)

(52) U.S. Cl. ..... 399/328; 399/329; 399/330

(58) Field of Classification Search ..... 399/328, 399/329, 330; 219/216
See application file for complete search history.

(56) References Cited

U.S. PATENT DOCUMENTS 5,359,401 A * 10/1994 Uehara et al. ..... 399/67
5,666,624 A * 9/1997 Kanesawa et al. ..... 399/329
5,697,036 A * 12/1997 Moser ..... 399/329
5,714,736 A * 2/1998 Yoneda et al. ..... 219/216
5,866,875 A * 2/1999 Okabayashi ..... 219/216
5,950,060 A * 9/1999 Isogai ..... 399/324
6,928,257 B2 * 8/2005 Ogiso et al. ..... 399/329
6,975,829 B2 * 12/2005 Aruga ..... 399/329
6,980,764 B2 * 12/2005 Otsuka et al. ..... 399/329
7,022,944 B2 * 4/2006 Yoshinaga et al. ..... 219/216
2004/0179876 A1 * 9/2004 Fuma et al. ..... 399/329
2005/0025537 A1 * 2/2005 Echigo et al. ..... 399/329
2005/0095043 A1 * 5/2005 Yoshinaga et al. ..... 399/329
2006/0067753 A1 * 3/2006 Katayanagi ..... 399/329

FOREIGN PATENT DOCUMENTS

JP 02-222980 9/1990
JP 07219380 A * 8/1995

(Continued)

*Primary Examiner*—David M. Gray
*Assistant Examiner*—Kristofferson Service
(74) *Attorney, Agent, or Firm*—Canon USA Inc I.P. Div

(57) ABSTRACT

An image heating apparatus includes a rotatable heating member configured to heat an image on a recording medium at a nip, driving means configured to drive the heating member, an endless belt configured to form the nip with the heating member, and a driving roller configured to drive the endless belt. In the image heating apparatus, the following expressions are satisfied:

$$\mu 2<\mu 1$$

$$0.005<\mu 2<0.3$$

$$V1<V2$$

where $\mu 2$ is a friction coefficient between the endless belt and the driving roller, $\mu 1$ is a friction coefficient between the heating member and the endless belt, V1 is a peripheral speed of the heating member, and V2 is a peripheral speed of the driving roller.

6 Claims, 16 Drawing Sheets

FOREIGN PATENT DOCUMENTS

| | | | | |
|---|---|---|---|---|
| JP | 08-166734 | | | 6/1996 |
| JP | 10-319772 | | | 12/1998 |
| JP | 2002287561 | A | * | 10/2002 |
| JP | 2004191858 | A | * | 7/2004 |
| JP | 2004302449 | A | * | 10/2004 |
| JP | 2005070453 | A | * | 3/2005 |

* cited by examiner

FOLLOWING ROTATION

SLOWER ROTATION

FASTER ROTATION

IMAGE HEATING APPARATUS

BACKGROUND OF THE INVENTION

1. Field of the Invention

The present invention relates to an image heating apparatus for heating an image on a recording medium. Examples of the image heating apparatus include a fixing apparatus for fixing an unfixed image on a recording medium and a gloss application apparatus for increasing gloss level of a fixed image on a recording medium by heating the image.

2. Description of the Related Art

In electrophotographic image forming devices, various systems for fixing unfixed toner images are known.

In the various systems, a belt fixing apparatus capable of increasing the size of a fixing nip portion in response to demands for high-speed image formation is proposed (see, for example, Japanese Patent Laid-Open Nos. 8-166734 and 10-319772).

The fixing apparatus has a structure in which a pressure belt is pressed into contact with a fixing roller, and a pressure pad is pressed against the fixing roller from the inner surface of the pressure belt. This structure can provide a long fixing nip portion extending from the pressure pad to a belt suspension roller.

In the fixing apparatus, the fixing roller is rotatably driven by a driving source, and the pressure belt is rotated by following movement of the fixing roller due to sliding friction force produced by sliding on the fixing roller. When a recording medium is present on the fixing nip portion, the pressure belt mainly receives transfer force via the recording medium. Therefore, the peripheral speed of the pressure belt depends on the conveying speed of the recording medium.

However, for a structure in which the pressure belt is rotated by following movement of the fixing roller, the conveying force provided to the pressure belt varies according to the type of the recording medium, environmental conditions, the type of a toner image. This may result in unstable rotation of the pressure belt.

For example, in the case where a large amount of unfixed toner remains over substantially the entire surface of the recording medium, when the recording medium enters the fixing nip portion, the coefficient of kinetic friction between the fixing roller and the recording medium tends to decrease, and the conveying force of the pressure belt decreases. As a result, the recording medium lags behind the fixing roller and the pressure belt slips on the fixing roller, and poor imaging (e.g., displacements of an image) occurs. In this case, the peripheral speed of the pressure belt is substantially the same as that of the conveying speed for the recording medium.

As described above, existing pressure-belt driving systems cannot offer high image quality.

With aim of preventing a recording medium from lagging, an apparatus including an override mechanism used as a driving mechanism is disclosed in Japanese Patent Laid-Open No. 2-222980. However, this mechanism is insufficient for completely solving the problems.

The system using this override mechanism has a structure in which, when a recording medium is not present on the fixing nip portion, the pressure belt is rotated by following movement of the fixing roller due to sliding friction force to the fixing roller, as in the case of the systems disclosed in Japanese Patent Laid-Open Nos. 8-166734 and 10-319772 mentioned above. In this structure, the pressure belt receives driving force only when the recording medium (toner image) slips on the fixing roller and the pressure belt lags behind the fixing roller. In other words, it takes time, however small, to change from when the peripheral speed of the pressure belt becomes lower than that of the fixing roller to when the pressure belt receives the driving force.

As a result, the speed of the pressure belt is changed in the course of fixing the toner image on the recording medium, and the speed change causes poor imaging, such as image displacements.

SUMMARY OF THE INVENTION

At least one exemplary embodiment of the present invention is directed to an image heating apparatus capable of reducing the occurrence of displacements of an image.

According to a first aspect of the present invention, an image heating apparatus includes a rotatable heating member configured to heat an image on a recording medium at a nip, driving means configured to drive the heating member, an endless belt configured to form the nip with the heating member, and a driving roller configured to drive the endless belt. The following expressions are satisfied:

$$\mu 2<\mu 1$$

$$0.005<\mu 2<0.3$$

$$V1<V2$$

where $\mu 2$ is a friction coefficient between the endless belt and the driving roller, $\mu 1$ is a friction coefficient between the heating member and the endless belt, $V1$ is a peripheral speed of the heating member, and $V2$ is a peripheral speed of the driving roller.

According to a second aspect of the present invention, an image heating apparatus includes a rotatable heating member configured to heat an image on a recording medium at a nip, driving means configured to drive the heating member, an endless belt configured to form the nip with the heating member, and a driving roller configured to drive the endless belt. When the heating member is in contact with the endless belt, a peripheral speed of the driving roller is higher than a peripheral speed of the endless belt, and the peripheral speed of the endless belt is substantially the same as a peripheral speed of the heating member. When the heating member is not in contact with the endless belt, the peripheral speed of the driving roller is substantially the same as the peripheral speed of the endless belt.

According to a third aspect of the present invention, an image heating apparatus includes a rotatable heating member configured to heat an image on a recording medium at a nip, driving means configured to drive the heating member, an endless belt configured to form the nip with the heating member, and a driving roller configured to drive the endless belt. The endless belt is driven by the heating member which is in contact with the endless belt, even though a peripheral speed of the driving roller is set to be higher than a peripheral speed of the heating member.

Further features of the present invention will become apparent from the following description of exemplary embodiments with reference to the attached drawings.

DESCRIPTION OF THE EMBODIMENTS

Exemplary embodiments are described below with reference to the accompanying drawings.

First Exemplary Embodiment

An exemplary general structure of an image forming device is described with reference to FIG. 1.

Figure 1:
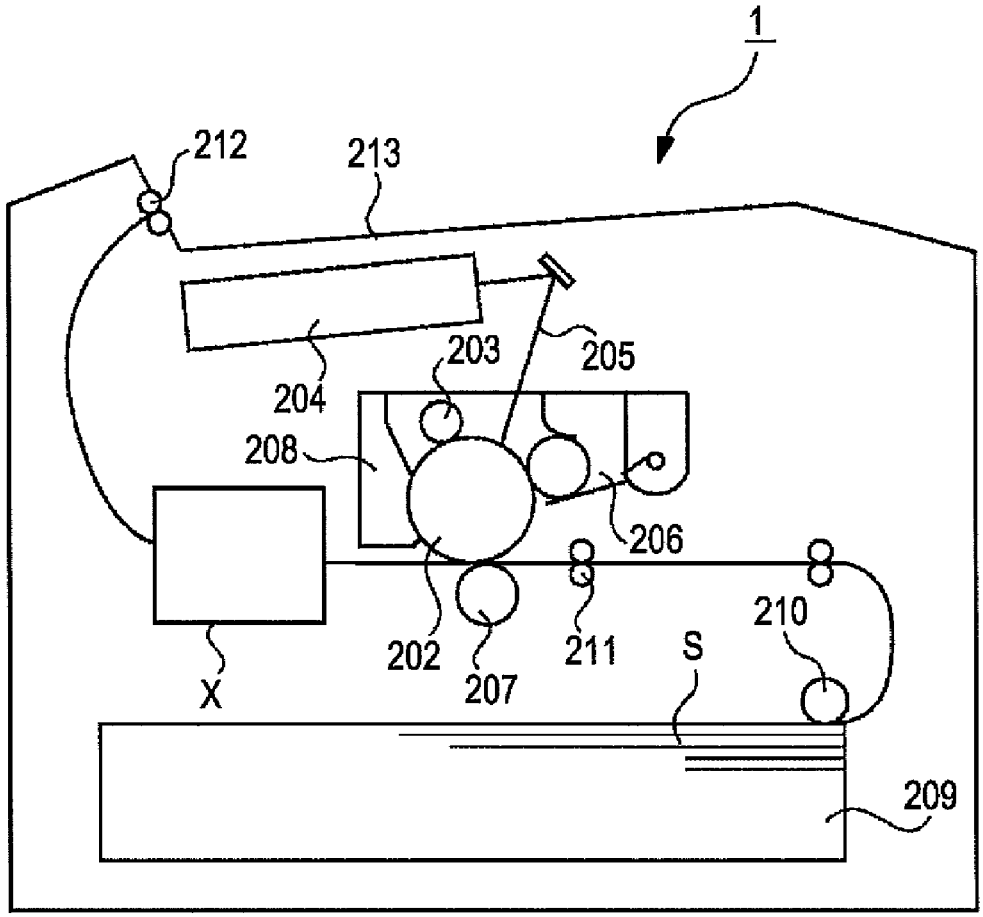
FIG. 1 is a schematic cross-sectional view of an image forming device.

An image forming device 1 illustrated in FIG. 1 is an electrophotographic image forming device (so-called printer).

The image forming device 1 includes two major components, i.e., an image forming unit for forming a toner image on a sheet serving as a recording medium and a fixing apparatus serving as an image heating apparatus for fixing the toner image formed on the sheet by heating and pressing the toner image.

(Image Forming Unit)

The image forming unit includes components described below.

A charger 203 serving as a charging unit is disposed adjacent to a photoconductor drum 202 serving as an image carrier. The surface of the photoconductor drum 202 is uniformly charged by the charger 203. When the photoconductor drum 202 is irradiated with a beam 205 from an exposing apparatus 204 serving as an exposing unit, an electrostatic latent image is formed on the photoconductor drum 202. The electrostatic latent image is developed by a developing apparatus 206 serving as a developing unit, so that a toner image is formed. A sheet S is held in a feeding cassette 209, and is conveyed by a feeding roller 210. The sheet S is conveyed in synchronization with the toner image on the photoconductor drum 202 via resist rollers 211 serving as a conveying unit. The toner image on the photoconductor drum 202 is electrostatically transferred to the sheet S by a transfer roller 207 serving as a transfer unit, and the sheet S is then conveyed to a fixing apparatus X. Toner particles remaining on the photoconductor drum 202 are removed by a cleaner 208 serving as a cleaning unit.

The toner image formed by the image forming unit on the sheet S is fixed by being heated and pressed by the fixing apparatus X. The sheet S with the fixed toner image is conveyed to an output tray 213 disposed in an upper part of the image forming device 1 through output rollers 212.

(Fixing Apparatus)

An exemplary structure of the fixing apparatus serving as the image heating apparatus is described below.

Figure 2:
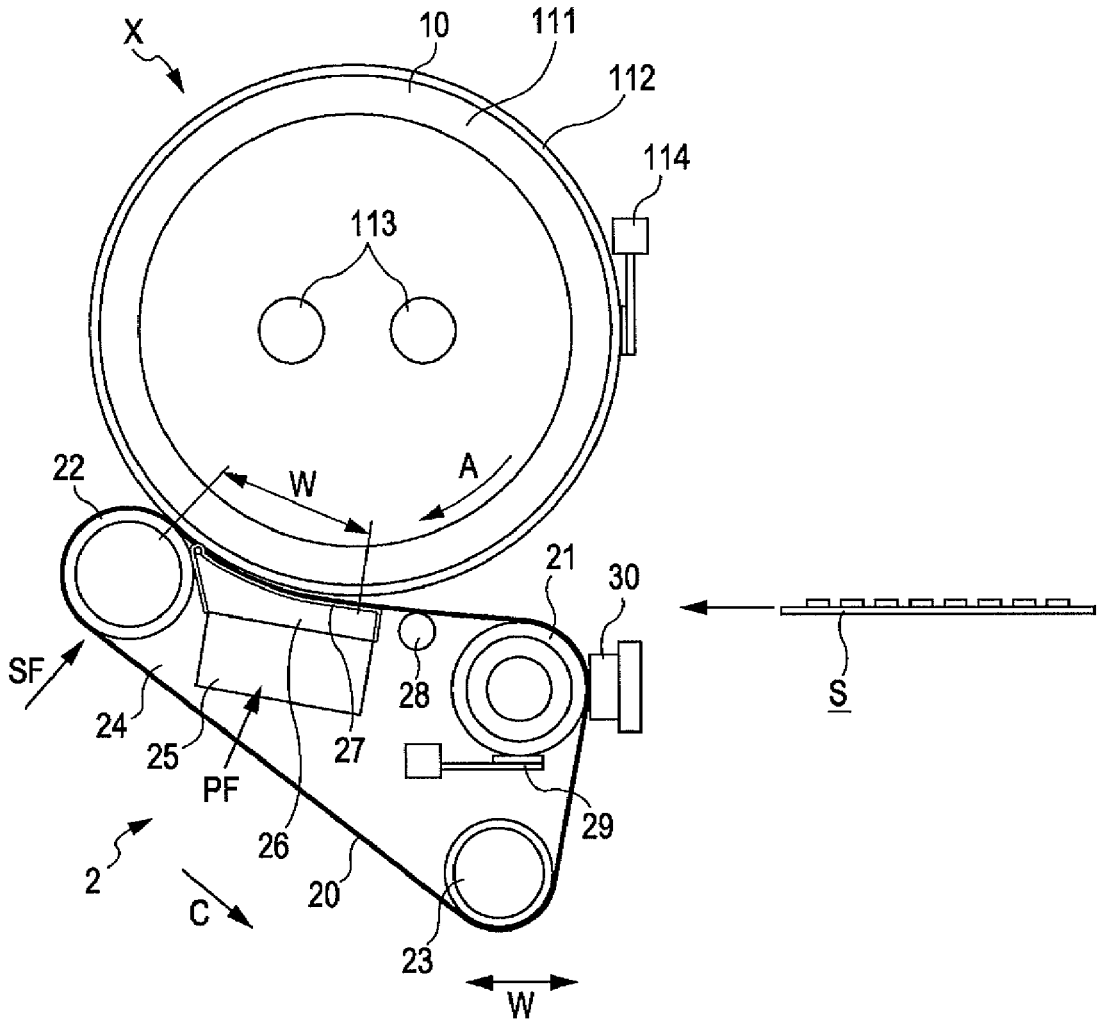
FIG. 2 is a schematic cross-sectional view of a fixing apparatus according to a first exemplary embodiment.

FIG. 2 illustrates a schematic structure of the fixing apparatus serving as the image heating apparatus.

As illustrated in FIG. 2, the fixing apparatus X includes a fixing roller 10 serving as a rotatable heating member (rotatable fixing member). The fixing roller 10 is rotatable in the direction of the arrow A by a driving motor serving as a driving unit and a driving gear train. The fixing roller 10 includes a core metal 111 formed from a metallic material (e.g., aluminum) and an elastic layer 112 formed from silicone rubber or other known materials disposed on the surface of the core metal 111. A halogen heater 113 serving as a heating source is disposed inside the fixing roller 10. The fixing roller 10 is heated by heat from the halogen heater 113. A thermistor 114 serving as a temperature detection element is disposed on the surface of the fixing roller 10 so as to be in contact with the fixing roller 10. A controller controls the current to be supplied to the halogen heater 113 depending on the results from the thermistor 114 and thus maintains the surface of the fixing roller 10 at a predetermined fixing temperature.

A belt unit 2 is disposed below the fixing roller 10. An endless pressure belt 20 is stretched around an inlet roller 21, a separation roller 22, and a steering roller 23.

The separation roller 22 is formed from a metallic material (e.g., stainless steel) and is pressed against the fixing roller 10 via the pressure belt 20 in the direction of the arrow SF with a predetermined pressure.

For the steering roller 23, only one end of a rotating shaft thereof is movable in the direction of the arrow W. Moving the rotating shaft of the steering roller 23 allows the pressure belt 20 to be shaken in the width direction.

The inlet roller 21 includes an incorporated halogen heater for heating the pressure belt 20.

A pressure pad unit 24 for forming a fixing nip portion is disposed between the inlet roller 21 and the separation roller 22. The pressure pad unit 24 includes a pressure base 25 formed from a metallic material (e.g., stainless steel) and a pressure pad 26 formed from silicone rubber or other materials known by one of ordinary skill in the relevant art. The surface of the pressure pad 26 is covered with a slide sheet 27 formed from polyimide film (PI film) or other members known by one of ordinary skill in the relevant art to reduce sliding resistance to the pressure belt 20. The pressure pad unit 24 having the structure described above is pressed in the direction of the arrow PF with a predetermined pressure.

Figure 3:
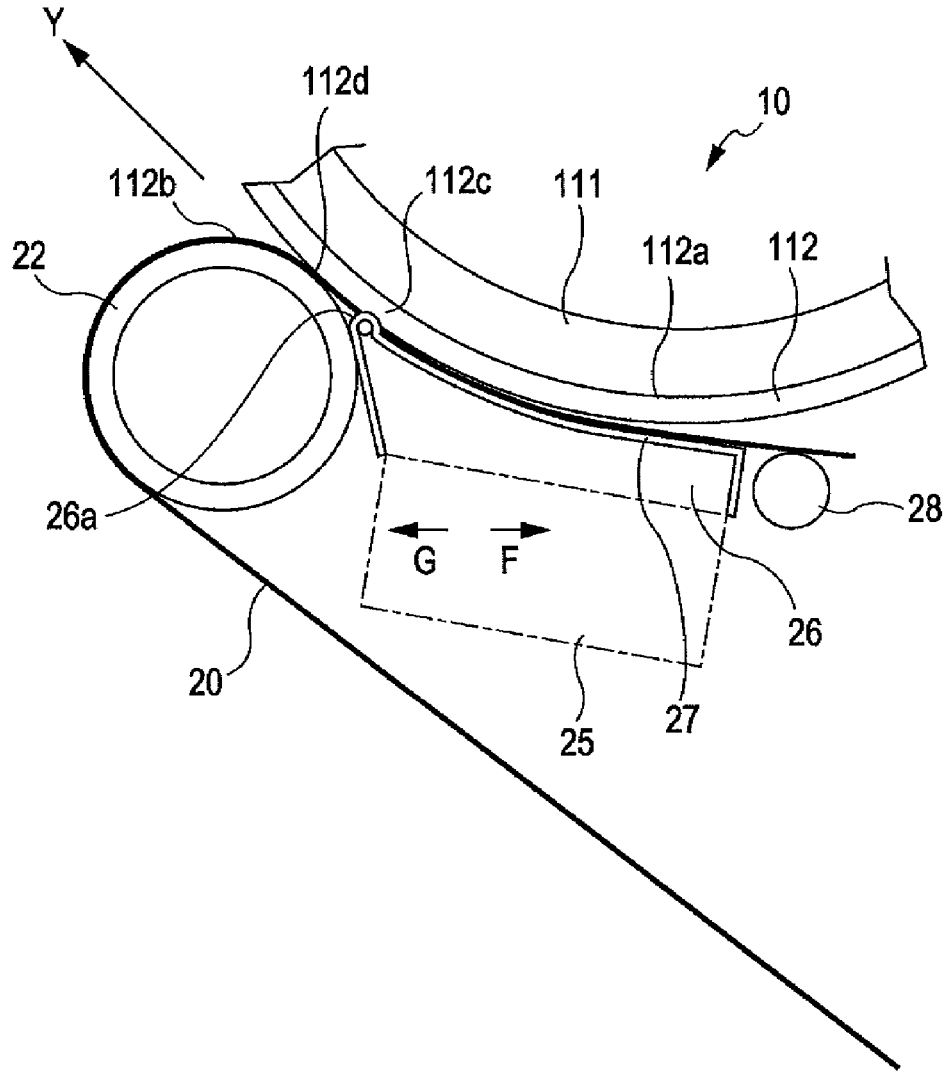
FIG. 3 is a schematic cross-sectional view of a main part of the fixing apparatus.

An oil application roller 28 for applying oil serving as lubricant to the pressure belt 20 is disposed between the inlet roller 21 and the pressure pad unit 24. The oil application roller 28 is impregnated with silicone oil and is constructed such that a certain amount of oil is supplied to the inner surface of the pressure belt 20. This reduces friction force between the pressure belt 20 and the slide sheet 27, thus increasing durability. FIG. 3 is an enlarged view of the separation roller 22 and its surroundings. Since the metallic separation roller 22 is pressed against the fixing roller 10 via the pressure belt 20 by the pressing unit, an elastic layer 112*a* of the fixing roller 10 is deformed as illustrated. In particular, at an end elastic layer 112*b* being in contact with the separation roller 22, the form of an arc of a circle of the elastic layer 112 is deformed in the opposite direction.

Since the toner image formed on the recording medium is fused and pressed at a nip portion W of the fixing apparatus X, the toner and the surface layer of the fixing roller 10 tend to be attached to each other. However, since the form of an arc of a circle is deformed in the opposite direction by the separation roller 22 at the end elastic layer 112*b* of the fixing roller 10, the toner that has been attached to the fixing roller 10 is separated, and the sheet S is ejected in the direction of the arrow Y.

A metallic wire 26*a* is disposed on an end of the pressure pad 26. The metallic wire 26*a* is integral with the pressure pad 26. The metallic wire 26*a* can deform an elastic layer 112*c* of the fixing roller 10.

The pressure belt 20, the fixing roller 10, the pressure pad unit 24, and the separation roller 22 form the long nip portion W. The nip width of the nip portion W can be longer than an existing roller fixing apparatus using a fixing roller and a pressure roller. Therefore, the toner on the recording sheet can be fused satisfactorily in a short period of time. As a result, this structure is suitable for an image forming device that consumes a large amount of toner, such as a color image forming device.

(Driving Mechanism of Fixing Apparatus)

Figure 4:
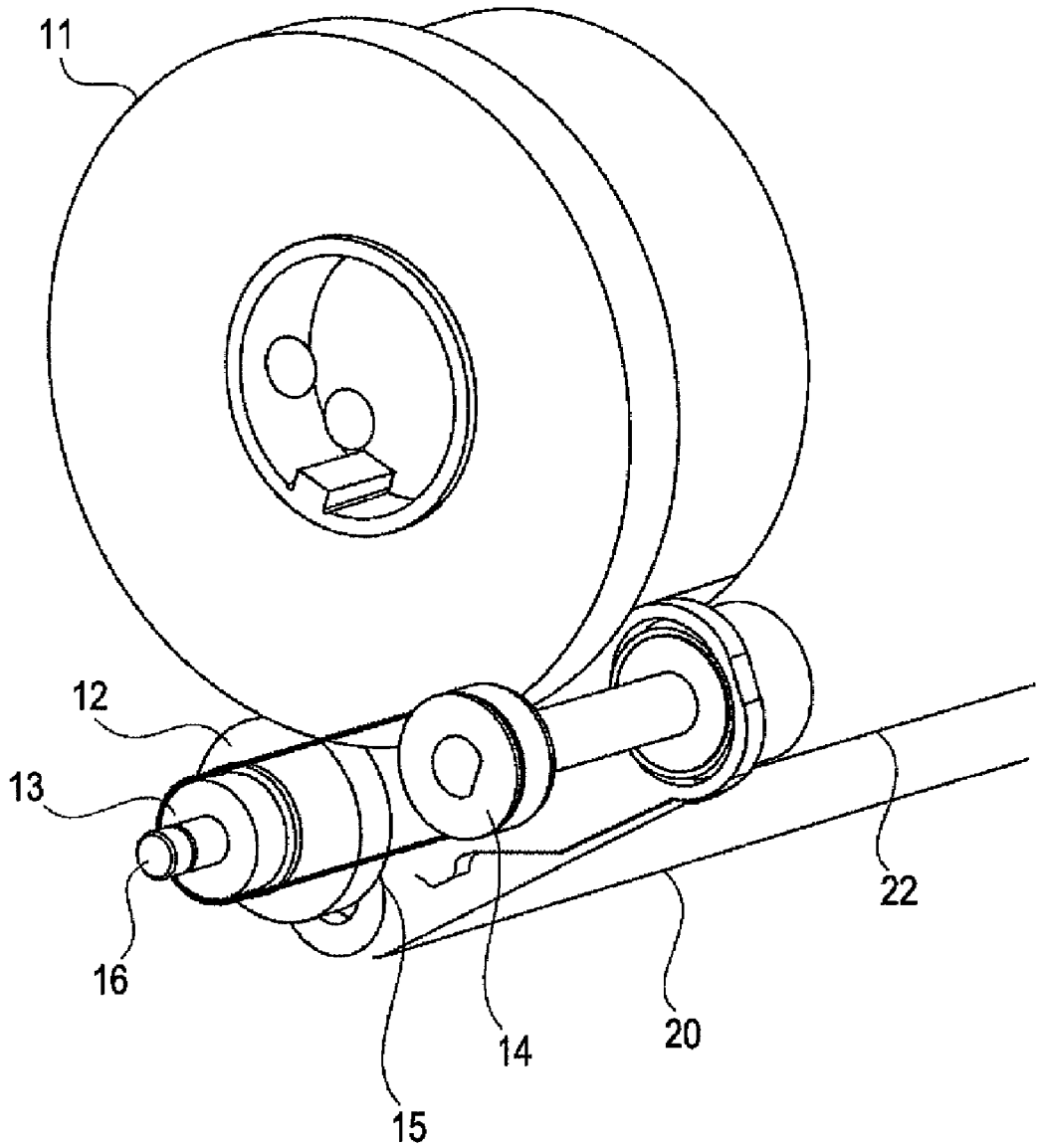
FIG. 4 is a schematic view of a driving mechanism in the fixing apparatus.

FIG. 4 illustrates an exemplary driving mechanism of the fixing apparatus.

The driving mechanism includes four gears (11, 12, 13, and 14), a transmission belt 15, and a tension roller (not shown).

A fixing gear 11 is secured to the fixing roller 10. The fixing roller 10 is driven by the inputting of driving force to the fixing gear 11 from a driving source.

The fixing gear 11 meshes with a first conveying gear 12. Therefore, the first conveying gear 12 receives the driving force from the driving source through the fixing gear 11. The first conveying gear 12 and a second conveying gear 13 are secured to a shaft 16.

The transmission belt 15 is stretched around the second conveying gear 13 and a separation drive gear 14. The tension roller (not shown) is pressed into contact with the transmission belt 15 so that the transmission belt 15 is stretched with a predetermined tension.

The separation drive gear 14 is secured to the separation roller 22. Therefore, the separation roller 22 receives the driving force from the driving source through the fixing gear 11, the first conveying gear 12, the second conveying gear 13, the transmission belt 15, and the separation drive gear 14. The separation roller 22 can be rotate at a desired peripheral speed by an appropriate combination of the number of teeth of each gear and the diameter of each roller. In this exemplary embodiment, the settings are determined so that the separation roller 22 receives a driving force so as to satisfy the relationships described below.

(Setting Conditions for Driving Fixing Apparatus)

The setting conditions for driving the fixing apparatus are described below. When the sheet S with an unfixed toner image is present on the fixing nip portion area, it is desirable that the toner be fixed without causing slippage between the unfixed toner and the fixing roller 10.

To this end, the fixing roller 10 can be driven, as described above, and the pressure belt 20 can be also driven independently. However, for this structure, it is difficult to drive both the fixing roller 10 and the pressure belt 20 at the identical speed because each component of the driving mechanism has a tolerance.

Therefore, in this exemplary embodiment, although the structure in which the fixing roller 10 and the pressure belt 20 can be driven independently of each other is adopted, the further settings are determined described below.

That is, although the structure in which the fixing roller 10 and the pressure belt 20 can be driven independently of each other is adopted, the pressure belt 20 follows movement of the fixing roller 10 in normal times.

In other words, the fixing apparatus according to this exemplary embodiment includes main driving mechanism for indirectly driving the pressure belt 20 through the use of the fixing roller 10 and sub driving mechanism for directly driving the pressure belt 20. The driving mechanism is further described below. In this exemplary embodiment, in order to satisfy the above relationship, the friction coefficient between the separation roller 22 and the pressure belt 20 is set to be smaller than that between the outer surface of the fixing roller 10 and the outer surface of the pressure belt 20.

In order to rotate the pressure belt 20 by following movement of the fixing roller 10, the friction coefficient between the outer surface of the separation roller 22 and the inner surface of the pressure belt 20 is set to be a negligible value.

In the case where the sheet S lags behind the fixing roller 10, the conveying force can be provided from the pressure belt 20 to the sheet S by using the separation roller 22 to which the driving force has been input. In other words, when the sheet S slips on the fixing roller 10, the conveying force can be supplied by the pressure belt 20.

More specifically, the peripheral speed is set so as to satisfy the following relationship:

(the peripheral speed of the separation roller 22)>(the peripheral speed of the inner surface of the pressure belt 20)

Therefore, inputting driving force to the separation roller 22 allows the conveying force to be supplied to the pressure belt 20 only when the conveying speed of the sheet is delayed, which is a problem in existing systems. As a result, an unfixed image formed on the sheet S is fixed and the sheet S is conveyed without causing slippage between the fixing roller 10 and the sheet S, thus reducing the occurrence of image displacements.

The setting in which the peripheral speed of the outer surface of the separation roller 22 is changed to be the same as the peripheral speed of the inner surface of the pressure belt 20 also means that the peripheral speed of the outer surface of the pressure belt 20 is higher than the peripheral speed of the fixing roller 10, which determines the setting conditions for the friction coefficients with respect to the fixing roller 10, the inner and outer surfaces of the pressure belt 20, and the separation roller 22.

The above mechanism is further described in order below.

If (the peripheral speed of the separation roller 22)>(the peripheral speed of the inner surface of the pressure belt 20), the situation described below occurs.

The friction conveying force F1 provided by the fixing roller 10 to the pressure belt 20 is smaller than the friction conveying force F2 provided by the separation roller 22 to the pressure belt 20, i.e., F1<F2. In this case, the pressure belt 20 is moved by the driving of the separation roller 22, which has a larger conveying force.

Therefore, the following relationship is satisfied:

(the peripheral speed of the outer surface of the pressure belt 20)>(the peripheral speed of the fixing roller 10)

Accordingly, a slippage between the pressure belt 20 and the fixing roller 10 occurs, and this causes a slippage between the fixing roller 10 and the sheet S. As a result, an image displacement occurs.

Consequently, it is desirable to satisfy the following relationship:

$$F1>F2$$

Therefore, it is desirable to satisfy the following relationship:

(the coefficient of kinetic friction between the fixing roller 10 and the outer surface of the pressure belt 20)>(the coefficient of kinetic friction between the inner surface of the pressure belt 20 and the separation roller 22)

Figure 5:
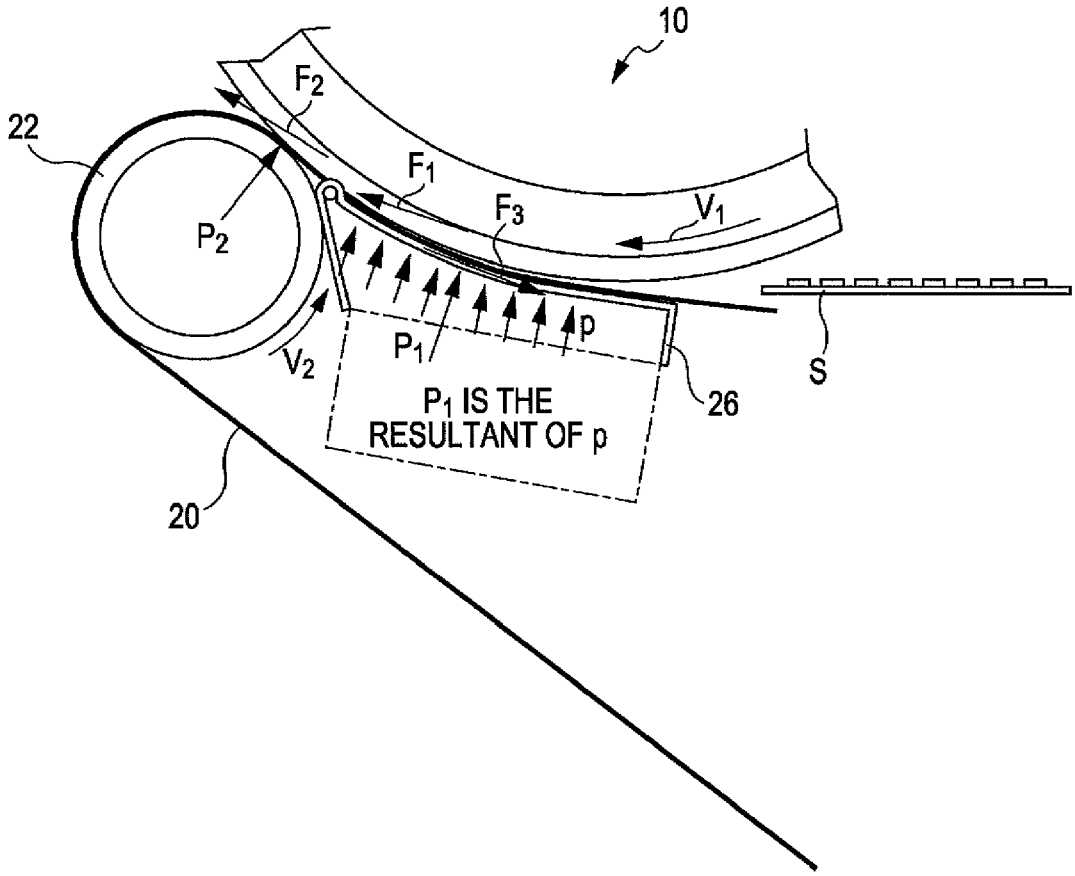
FIG. 5 illustrates the friction forces and velocities during conveyance of a sheet.

FIG. 5 illustrates the friction forces produced between sliding members and the peripheral velocities during conveyance of the sheet S.

In this exemplary embodiment, the nip portion is formed by causing the separation roller 22 and the pressure pad 26 to be pressed into contact with the pressure belt 20. Therefore, the sliding friction force F2 to the separation roller 22 (the driving force of the separation roller 22) and the sliding friction force F3 to the pressure pad 26 (the brake force of the pressure pad 26) occur from the inner surface of the pressure belt 20. Since the pressure pad 26 is securely supported, the occurrence of image displacements can be prevented if the following expression is satisfied:

$$F_1>(F_2-F_3)$$

In FIG. 5, $F_1$, is the fixing driving force ($=\mu_1\times(P_1+P_2)$), $F_2$ is the driving force of the separation roller 22 ($=\mu_2\times P_2$), $F_3$ is the driving force of the pressure pad 26 ($=\mu_3\times P_1$), $V_1$ is the peripheral speed of the fixing roller 10 (=100 [mm/s]), $V_2$ is the peripheral speed of the separation roller 22 (=103 [mm/s]), $P_1$, is the pressure of the pressure pad 26 (=471 to 510 [N]), and $P_2$ is the pressure of the separation roller 22 (=412 to 451 [N]) wherein $\mu_1$ is the coefficient of kinetic friction between the fixing roller 10 and the outer surface of the pressure belt 20, $\mu_2$ is the coefficient of kinetic friction between the inner surface of the pressure belt 20 and the separation roller 22, and $\mu_3$ is the coefficient of kinetic friction between the pressure belt 20 and the slide sheet 27.

The inlet roller 21 and the steering roller 23 are both rotatably supported by a bearing (not shown) and rotated by following movement of the pressure belt 20. Therefore, the coefficient of kinetic friction between the inner surface of the pressure belt 20 and each of the inlet roller 21 and the steering roller 23 is negligible, compared with that between the inner surface of the pressure belt 20 and the separation roller 22 and that between the inner surface of the pressure belt 20 and the slide sheet 27. Therefore, the load from each of the inlet roller 21 and the steering roller 23 is ignored.

Therefore, even when (the coefficient of kinetic friction between the fixing roller 10 and the inner surface of the pressure belt 20)>(the coefficient of kinetic friction between the inner surface of the pressure belt 20 and the separation roller 22), if (the coefficient of kinetic friction between the fixing roller 10 and the outer surface of the pressure belt 20)<(the coefficient of kinetic friction between the pressure belt 20 and the slide sheet 27), there is a possibility that the pressure belt 20 does not follow movement of the fixing roller 10 and slips thereon.

To address this, the coefficient of kinetic friction, $\mu_1$, between the fixing roller 10 and the outer surface of the pressure belt 20 is set to be larger than the coefficient of kinetic friction, $\mu_2$, between the inner surface of the pressure belt 20 and the separation roller 22 and the coefficient of kinetic friction, $\mu_3$, between the pressure belt 20 and the slide sheet 27. As a result, the occurrence of image displacements can be prevented regardless of what material is used in these components.

(Method for Measuring Coefficient of Kinetic Friction and Verifications)

An exemplary method for measuring the coefficient of kinetic friction and results are described below.

Figure 6:
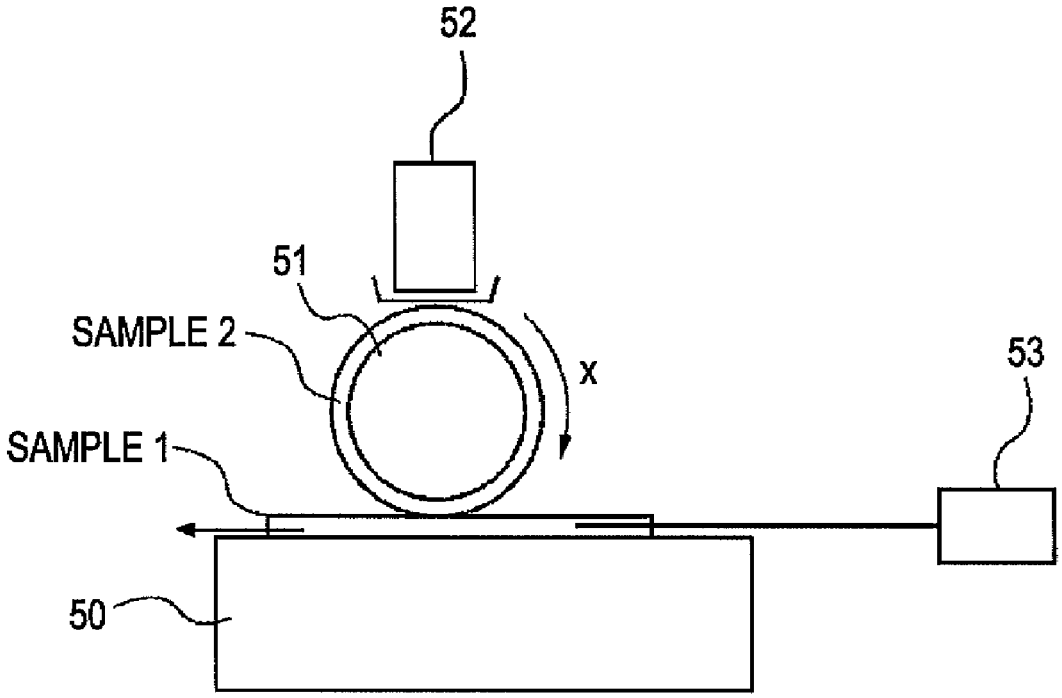
FIG. 6 illustrates a method for measuring the coefficient of kinetic friction between the members.

As illustrated in FIG. 6, a sample 1 to be measured (70 [mm]×50 [mm]) is secured to a plate 50. A sample 2 to be measured which is a rotatable member 51 is secured. Examples of the rotatable member 51 include the fixing roller 10 and the separation roller 22.

Subsequently, a weight load 52 of 2.9 [N] is put on the rotatable member 51. Then, with a tension gage 53 connected, the rotatable member 51 is placed on the sample 1 on the plate 50.

Under an indoor environment of 23° C. and 50% RH, the rotatable member 51 is rotated in the direction of the arrow x at a speed of 100 [mm/s], and an output value F from the tension gage 53 at this time is read as a measurement value. Since the output value F is unstable immediately after the measurement starts, a plurality of stable output values F are obtained as measurement values and the measured values are averaged.

The average value of the output values F from the tension gage 53 obtained in this way is substituted into the following expression to calculate the coefficient of kinetic friction, μ.

$$F=\mu\times N$$

where μ is the coefficient of kinetic friction and N is a load of the weight of 2.9 [N].

The results of experiments conducted by the present inventor et al. show the following relationships:

$$\mu_1=0.25\ \mu_2=0.1$$

$$\mu_3=0.14$$

Therefore, the following relationships are satisfied:

$$\mu_1>\mu_2,\ \mu_1>\mu_3$$

In addition, the following relationships are satisfied:

$$F_1=\mu_1\times(i\ P_1+P_2)=230\ [N]$$

$$F_2=\mu_2\times P_2=43\ [N]$$

$$F_3=\mu_3\times P_1=65\ [N]$$

Therefore, the following relationship is satisfied:

$$F_1>(F_2-F_3)$$

Since the above conditions were satisfied, no image displacement occurred.

The conditions for preventing the occurrence of image displacements with respect to $\mu_3$ were shown above. When the peripheral speed of the separation roller 22 had several different values, the presence/absence of an image displacement occurred or not was observed. Table 1 shows the results. In Table 1, the left-hand column indicates the ratios of the peripheral speed of the separation roller 22 to that of the fixing roller 10 for different values of the peripheral speed of the separation roller 22 where the peripheral speed of the fixing roller 10 had a fixed value. The right-hand column indicates whether an image displacement occurred or not; X denotes that the image displacement occurred and ○ denotes that no image displacement occurred.

TABLE 1

| Ratio of Peripheral Speed of Separation Roller to that of Fixing Roller | Image Displacement |
|---|---|
| Following Movement | X |
| 0.99 | X |
| 1.01 | ○ |
| 1.03 | ○ |
| 1.05 | ○ |
| 1.07 | ○ |
| 1.2 | ○ |
| 1.25 | X |

Table 1 shows that no image displacement occurred when $V_1<V_2$. Therefore, the occurrence of image displacements can be prevented by driving the separation roller 22 so that the peripheral speed of the separation roller 22 is higher than that of the inner surface of the pressure belt 20 regardless of the difference in speed. In this exemplary embodiment, the ratio $V_2/V_1$ is set to 1.03. It is desired that the peripheral speed ratio $V_2/V_1$ be set according to the magnitude of the load on the belt (e.g., the load caused by the pressure pad 26).

However, when the peripheral speed ratio was larger than 1.2 (20[%]), the durability of the pressure belt 20 decreased because of the friction between the pressure belt 20 and the separation roller 22. At this time, the coefficient of kinetic friction between the separation roller 22 and the inner surface of the pressure belt 20, $\mu_2$, was 0.005.

When the peripheral speed ratio was larger than 1.2 (20 [%]), oil contained in the oil application roller 28 was exhausted in a short time due to frictional heat, and a slippage between the fixing roller 10 and the pressure belt 20 occurred. At this time, the coefficient of kinetic friction between the separation roller 22 and the inner surface of the pressure belt 20, $\mu_2$, was 0.3.

Figure 7:
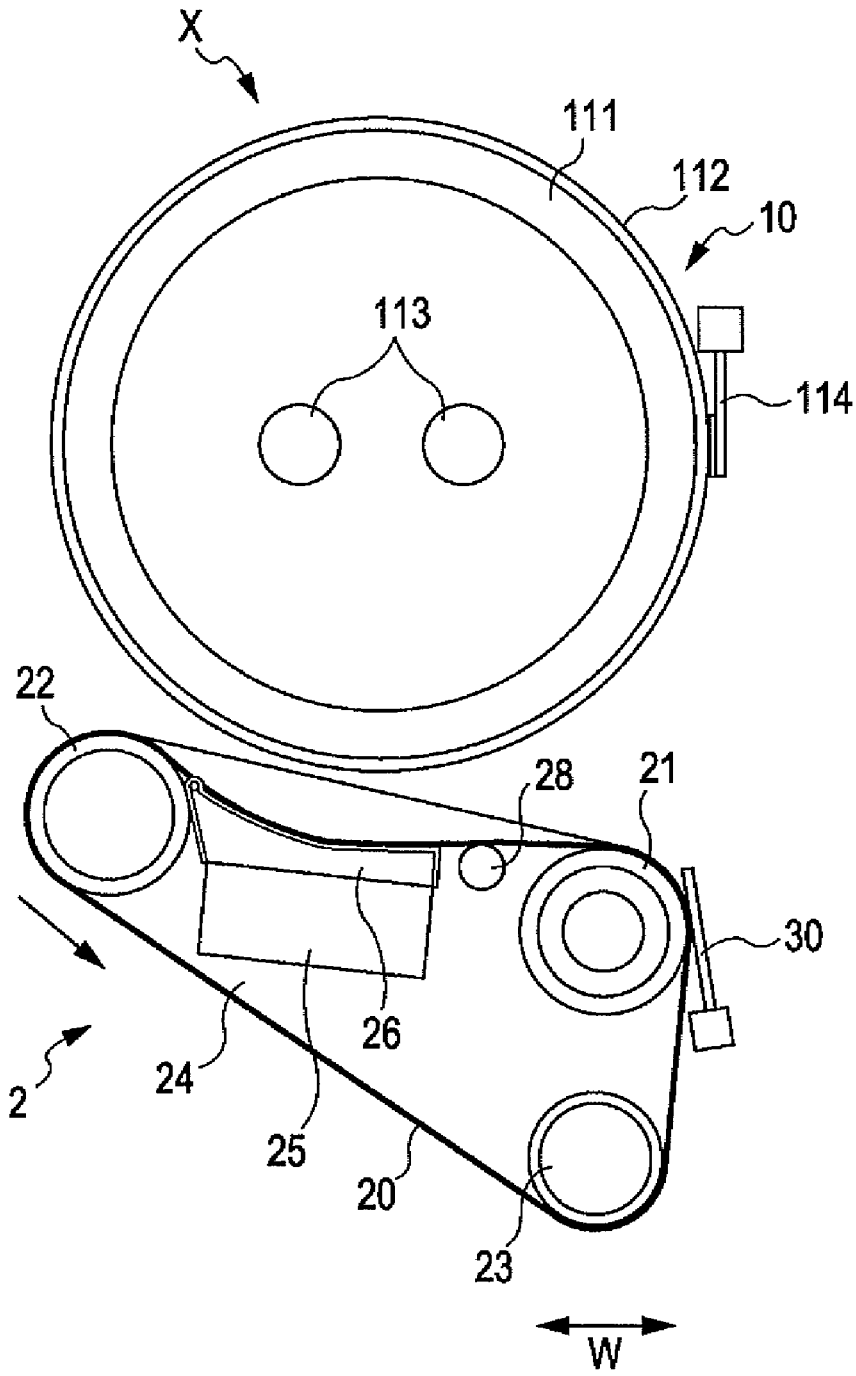
FIG. 7 illustrates the positional relationship in the fixing apparatus during standby.

Therefore, it is desired that the following three expressions be satisfied:

$$1<V_2/V_1<1.2 \quad (1)$$

$$0.005<\mu_2<0.3 \quad (2)$$

$$\mu_2>0.14 \quad (3)$$

where $V_1$ is the peripheral speed of the fixing roller 10, $V_2$ is the peripheral speed of the separation roller 22, $\mu_2$ is the coefficient of kinetic friction between the separation roller 22 and the inner surface of the pressure belt 20, and $\mu_3$ is the coefficient of kinetic friction between the pressure belt 20 and the slide sheet 27. FIG. 7 illustrates the fixing apparatus when the sheet S is not conveyed. In this state, the pressure belt 20 is not pressed against the fixing roller 10 and is not in contact with the fixing roller 10.

Conveyance of the pressure belt 20 does not depend on friction force caused by sliding and rubbing between the pressure pad 26 and the pressure belt 20. Therefore, the rotation force applied to the pressure belt 20 is determined by friction force between the inner surface of the pressure belt 20 and a plurality of rollers, i.e., the inlet roller 21, the separation roller 22, and the steering roller 23.

It is desired that the following expression be satisfied:

$$F_3>(F_4+F_5)$$

where $F_3$ is the friction force between the separation roller 22 and the pressure belt 20, $F_4$ is the friction force between the inlet roller 21 and the pressure belt 20 and $F_5$ is the friction force between the steering roller 23 and the pressure belt 20.

As a result, since the pressure belt 20 is driven by the separation roller 22 (rotated by following movement of the separation roller 22), the peripheral speed of the inner surface of the pressure belt 20 is approximately equal to the peripheral speed of the separation roller 22.

In this exemplary embodiment, since the inlet roller 21 and the steering roller 23 are rotatably supported by a bearing, $F_4$ and $F_5$ are negligible, compared with $F_3$. Therefore, the above relationship is satisfied.

Since the fixing apparatus according to this exemplary embodiment satisfies the above relationships, when the pressure belt 20 is pressed into contact with the fixing roller 10 (during fixing processing), the peripheral speed of the separation roller 22 is higher than that of the pressure belt 20. At this time, the pressure belt 20 is rotated by following movement of the fixing roller 10, and the peripheral speed of the fixing roller 10 is substantially the same as that of the pressure belt 20 (tolerance effects are ignored). In contrast, when the fixing roller 10 and the pressure belt 20 are not in contact with each other (in a standby state in which fixing operation is disabled), the pressure belt 20 is rotated by following movement of the separation roller 22, and the peripheral speed of the separation roller 22 is substantially the same as that of the pressure belt 20 (tolerance effects are ignored). At this time, the peripheral speed of the pressure belt 20 is higher than that of the fixing roller 10 (the peripheral speed during fixing processing described above).

Second Exemplary Embodiment

The second exemplary embodiment is different from the first exemplary embodiment in that the fixing roller 10 is replaced with a fixing belt.

Although the fixing belt and a pressure belt can be driven independently of each other, the pressure belt can be rotated by following movement of the fixing belt. Otherwise, the configuration is substantially the same as that of the first exemplary embodiment. The details are described below.

Figure 8:
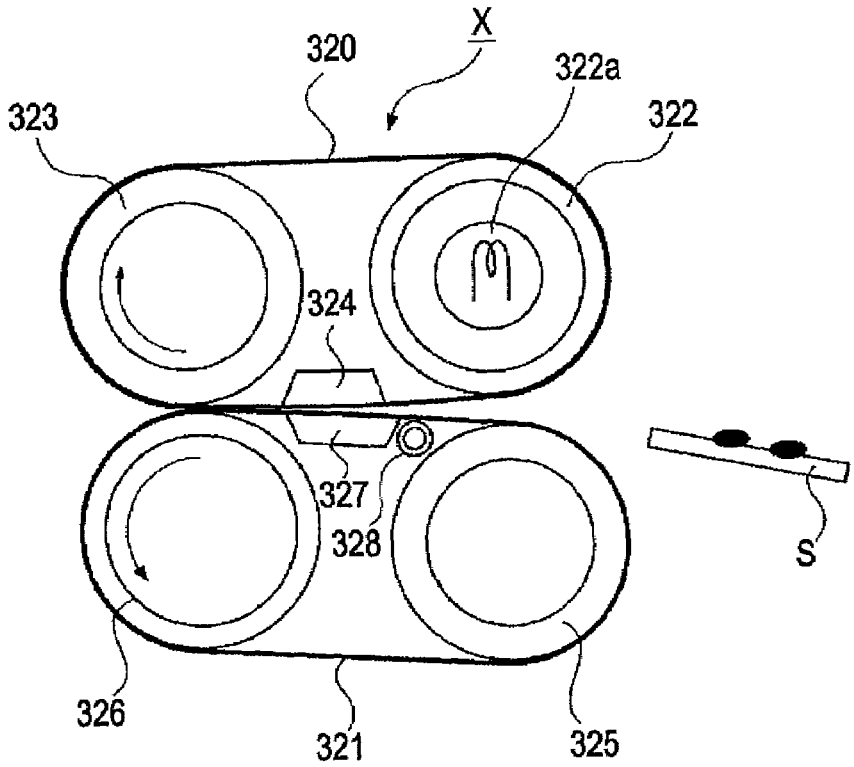
FIG. 8 is a cross-sectional view of the fixing apparatus according to a second exemplary embodiment.

FIG. 8 is a cross-sectional view of the fixing apparatus X according to the second exemplary embodiment. As illustrated in FIG. 8, the fixing apparatus X includes a fixing belt (rotatable heating member) 320 as a first endless belt and a pressure belt (rotatable pressing member) 321 as a second endless belt.

The fixing belt 320 includes a polyimide base layer having an inner diameter of 40 mm and a thickness of 75 μm and an elastic layer having a thickness of 300 μm disposed on the outer surface of the base layer. The elastic layer can be formed from a known material, and examples thereof include silicone rubber and fluorine rubber.

In this exemplary embodiment, the elastic layer is formed from silicone rubber with a JIS-A hardness of 20° and a thermal conductivity of 0.8 W/mK. Deformation of the elastic layer can prevent a sheet from winding around the fixing belt 320, so that excellent separability from the belt can be obtained. In addition, a fluoroplastic layer having a thickness 30 μm serving as a surface release layer is disposed on the outer surface of the elastic layer. Examples of the material of the fluoroplastic layer include PFA and PTFE.

The pressure belt 321 includes a polyimide base layer having an inner diameter of 40 mm and a thickness of 75 μm and a release layer having a thickness of 30 μm disposed on the outer surface of the base layer. The release layer is a fluoroplastic PFA tube.

The fixing belt 320 is stretched around a heating roller 322 serving as a suspension roller and a fixing roller 323 serving as a first driving roller.

The heating roller 322 is a hollow iron roller having an outer diameter of 20 mm, an inner diameter of 18 mm, and a thickness of 1 mm and includes a halogen heater 322*a* as a heating unit disposed therein. The heating roller 322 also functions as a tension roller.

The fixing roller 323 is an elastic roller having an outer diameter of 20 mm and including an iron-alloy core metal having a diameter of 18 mm and a silicone rubber layer as an elastic layer disposed on the core metal. The provision of the elastic layer can satisfactorily transmit to the fixing belt 320 driving force input from a driving source (motor) via a driving gear train and can form a fixing nip for ensuring separability of a sheet from the fixing belt 320. In order to avoid the fixing belt 320 from lagging, the fixing roller 323 includes a high sliding resistance layer (rubber layer) thereon so as not to cause a slippage between the fixing roller 323 and the fixing belt 320.

The pressure of the fixing nip portion is set to exhibit the maximum value in an area where the fixing nip portion is stretched by the fixing roller 323.

The silicone rubber layer has a JIS-A hardness of 15° and a thermal conductivity of 0.8 W/mK. The silicone rubber layer can reduce thermal conduction to the inside and can facilitate reduction in the warm-up time.

A fixing pad 324 serving as a first securing member for pressing the fixing belt 320 toward the pressure belt 321 is disposed upstream from the fixing roller 323 inside the fixing belt 320 in the direction of conveying a recording medium.

The fixing pad 324 is formed form heat-resistant silicone rubber as an elastic member and has a thickness of 3 mm and a width of 12 mm.

In order to reduce friction force to the inner surface of the fixing belt 320 sliding on the fixing pad 324, a pad cover in which a glass fiber cloth is coated with a fluoroplastic layer is disposed on the surface of the fixing pad 324.

The pad cover suppresses driving torque of the fixing roller 323, thus allowing the fixing belt 320 to be stably rotated without having to increase the size of the motor.

The pressure belt 321 is stretched around a tension roller 325 serving as a suspension roller and a pressure roller 326 serving as a second driving roller.

The tension roller 325 has an outer diameter of 20 mm and includes an iron-alloy core metal having a diameter of 16 mm and a silicone sponge layer to reduce thermal conductivity and reduce thermal conduction from the pressure belt 321.

The pressure roller 326 is an iron-alloy rigid roller having an outer diameter of 23.5 mm, an inner diameter of 19.5 mm, and a thickness of 2 mm. The pressure roller 326 receives driving force from a driving source (motor) via a driving gear train. In this exemplary embodiment, this driving source provides the fixing roller 323 with driving force. The pressure roller 326 is a mirror-finished metallic roller that has no rubber layer to allow a slippage to the pressure belt 321 to occur.

A pressure pad 327 serving as a second securing member for pressing the pressure belt 321 toward the fixing belt 320 is disposed upstream from the pressure roller 326 inside the pressure belt 321 in the direction of conveying a recording medium.

In order to reduce friction force to the inner surface of the pressure belt 321 sliding on the pressure pad 327, a pad cover in which a glass fiber cloth is coated with a fluoroplastic layer is disposed on the surface of the pressure pad 327, as in the case of the fixing pad 324.

An oil application member 328 for applying oil serving as lubricant to the inner surface of the pressure belt 321 is disposed inside the pressure belt 321.

The oil application member 328 is a roller and includes a core metal and an oil holding layer formed from, for example, aramid fiber impregnated with oil disposed on the core metal. The surface of the oil application member 328 is coated with a porous fluoropolymer layer for allowing oil to be supplied.

The supply of silicone oil to the pressure belt 321 can be adjusted by adjusting the amount of oil contained in the oil holding layer, the pore diameter in the oil supply layer, pore density in the oil supply layer, the pressure when the oil application member 328 comes into contact with the pressure belt 321, or the difference in the peripheral speed.

The oil application member 328 can be a pad, other than a roller. In the case of a structure in which oil in the pressure belt 321 is less prone to decreasing, if a predetermined quantity of oil is applied to the inner surface the pressure belt 321, the oil application member 328 is not required.

If the viscosity of the silicone oil is too small, the silicone oil leaks from the inner surface of the pressure belt 321. On the other hand, if the viscosity is too large, the viscosity resistance between the pressure belt 321 and the pressure pad 327 at the nip is too large. Therefore, it is desired to use oil that has a kinematic viscosity of 100 to 10,000 $mm^2/s$ (100 cSt to 10,000 cSt) at 25° C. The quantity of oil applied to the pressure belt 321 will be described below.

To form the fixing nip portion, the opposite ends of the rotating shaft of the pressure roller 326 are pressed toward the fixing roller 323 by a pressing mechanism with a pressure of 343 N (35 kgf).

To form the fixing nip portion between the fixing pad 324 and the pressure pad 327, a support plate holding the pressure pad 327 is also pressed by the pressing mechanism with a pressure of 343 N (35 kgf).

Each of the fixing roller 323 and the pressure roller 326 receives a driving force from the driving motor via the driving gear train, and rotates at a predetermined peripheral speed during fixing operation.

The peripheral speed of the fixing roller 323 and that of the pressure roller 326 are made different. One method to do so is to provide the fixing roller 323 and the pressure roller 326 with the respective driving motors. In this exemplary embodiment, however, a common driving source (motor) is used for both fixing and pressing sides, and the gear ratios of the driving gear trains for transmitting driving forces to the fixing roller 323 and the pressure roller 326 are set to differ from each other.

In this exemplary embodiment, the fixing nip portion formed by the fixing belt 320 and the pressure belt 321 has a length in the sheet conveyance direction of about 18 mm. Such a long nip length allows sufficient fixing even when the speed of image formation is enhanced.

Since the fixing side and the pressing side use their respective endless belts as a member relating to fixing, the fixing apparatus according to this exemplary embodiment can realize a lower thermal capacity, compared with that of the first exemplary embodiment. This facilitates reduction in the warm-up time (the time taken by the image forming device that is in a ready state to fix an image after turning on the power).

The fixing roller 323 is rotatably driven by the motor at least when the image formation is performed. The peripheral speed of the fixing belt 320 is slightly lower than the speed of conveying the sheet S conveyed from the image forming side to create a loop in the sheet S.

When the fixing belt 320 is in a state in which the temperature is controlled after rising to a predetermined fixing temperature, the sheet S with an unfixed toner image T is conveyed to the fixing nip portion between the fixing belt 320 and the pressure belt 321.

The sheet S is inserted therebetween such that a surface on which the unfixed toner image is placed faces the fixing belt 320. The sheet S is nipped and conveyed while the unfixed toner image T of the sheet S is closely attached to the outer surface of the fixing belt 320, thus receiving heat from the fixing belt 320 and also receiving pressure. As a result, the unfixed toner image is fixed on the surface of the sheet S.

The fixing roller 323 disposed inside the fixing belt 320 is an elastic roller having a rubber layer, whereas the pressure roller 326 disposed inside the pressure belt 321 is an iron-alloy rigid roller. Therefore, at an outlet of the fixing nip portion between the fixing belt 320 and the pressure belt 321, the fixing roller 323 becomes deformed more largely. As a result, the fixing belt 320 becomes deformed largely, and the sheet S with the toner image is separated from the fixing belt 320 due to the rigidity of the sheet S.

An exemplary driving mechanism of the fixing apparatus X is described below. First, the relationship between the speed of the pressure roller 326 and the quantity of oil applied to the inner surface of the pressure belt 321 is described in detail.

Table 2 shows the forces acting between the members forming the nip portion in the fixing apparatus X which were obtained by measuring them individually.

The pressure driving force F3 is the kinetic friction force acting between the pressure roller 326 and the pressure belt 321 when silicone oil is applied thereto.

The pressure sliding force F4 is the kinetic friction force acting between the pressure belt 321 and the pressure pad 327 when silicone oil is applied thereon.

The friction force between belts F5 is the kinetic friction force acting between the fixing belt 320 and the pressure belt 321 outside an area where paper can pass when the sheet (of paper) S is present therebetween.

The fixing to paper friction force F6 is the maximum static friction force acting between the fixing belt 320 and the sheet S on which toner is placed.

The pressure to paper friction force F7 is the maximum static friction force acting between the pressure belt 321 and the sheet S.

Table 2 shows that the force acting on the pressure belt 321 varies depending on the quantity of oil applied to the inner surface of the pressure belt 321.

For the conditions for driving the pressure roller 326 with respect to a first condition in which no driving force was applied to the pressure roller 326 (rotated by following movement of another member, referred to as following movement), a second condition in which the pressure roller 326 was rotated slower than the fixing roller 323, and a third condition in which the pressure roller 326 was rotated faster than the fixing roller 323, the force relationships for different oil quantities were measured.

TABLE 2

| | | | F[N] | | | |
|---|---|---|---|---|---|---|
| Mark | Force Name | Place | 0.0 mg/mm$^2$ | 0.015 mg/mm$^2$ | 0.03 mg/mm$^2$ | 0.05 mg/mm$^2$ |
| F1 | fixing driving force | fixing roller and fixing belt | 392.0 | 392.0 | 392.0 | 392.0 |
| F2 | fixing sliding resistance | fixing belt and fixing pad | 86.2 | 86.2 | 86.2 | 86.2 |
| F3 | pressure driving force | pressure roller and pressure belt (with oil) | 118.5 | 99.3 | 135.6 | 147.4 |
| F4 | pressure sliding force | pressure belt and pressure pad (with oil) | 51.0 | 66.6 | 223.4 | 580.2 |
| F5 | friction force between belts | fixing belt and pressure belt (outside paper passing area) | 3.8 | 3.8 | 3.8 | 3.8 |
| F6 | fixing to paper friction force | fixing belt and paper | 129.4 | 129.4 | 129.4 | 129.4 |
| F7 | pressure to paper friction force | pressure belt and paper | 129.4 | 129.4 | 129.4 | 129.4 |

The fixing driving force F1 is the maximum static friction force acting between the fixing roller 323 and the fixing belt 320.

The fixing sliding resistance F2 is the kinetic friction force acting between the fixing belt 320 and the fixing pad 324.

The direction acting on the sheet S varies depending on the condition for driving the pressure roller 326. Therefore, the force acting between the fixing belt 320 and the sheet S and the force acting between the pressure belt 321 and the sheet S vary.

Therefore, the force acting between the fixing belt 320 and the sheet S is indicated by F6' and the force acting between the pressure belt 321 and the sheet S is indicated by F7'.

Figure 9:
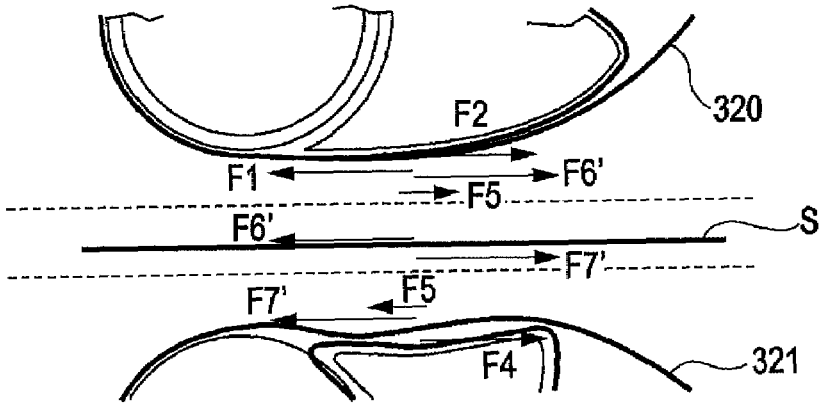
FIG. 9 illustrates the types and directions of forces when the pressure driving is following rotation.
Figure 10:
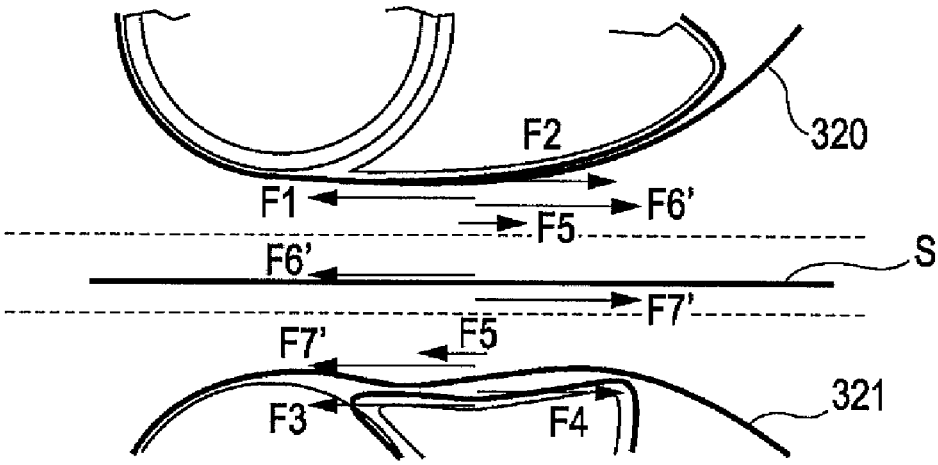
FIG. 10 illustrates the types and directions of forces when the pressure driving is slower rotation.
Figure 11:
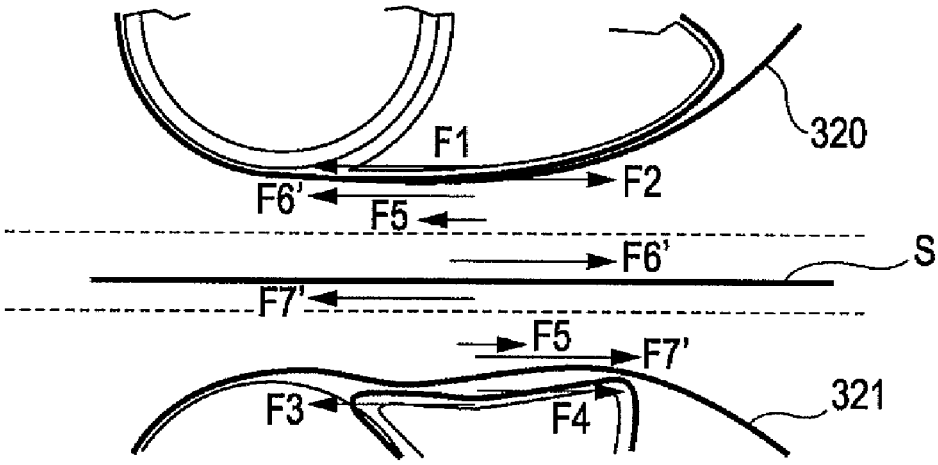
FIG. 11 illustrates the types and directions of forces when the pressure driving is faster rotation.

FIG. 9 illustrates the forces acting on the fixing belt 320, the sheet S, and the pressure belt 321 and the directions thereof for the first condition, i.e., following rotation. FIG. 10 illustrates those for the second condition, i.e., slower rotation, and FIG. 11 illustrates those for the third condition, i.e., faster rotation. Here, among recommended sheets S for this device, a sheet that is the most slippery and whose surface (image surface) is coated with resin was used in this verification.

A condition for causing a slippage between the fixing belt 320 and the sheet S is F6<F7'.

A condition for causing a slippage between the pressure belt 321 and the sheet S is F7<F6'.

Table 3 shows the calculation results for the force relationships with respect to each of the driving conditions according to different oil quantities applied to the inner surface of the pressure belt 321. In Table 3, x indicates a condition that causes paper to slip, Δ indicates a condition that does not cause paper to slip and the difference to the maximum friction force is less than 98 N (10 kgf), and ○ indicates the condition that does not cause paper to slip and the difference to the maximum friction force is equal to or larger than 98 N.

TABLE 3

| | Oil Quantity [mg/mm$^2$] | | | |
|---|---|---|---|---|
| Slip | 0 | 0.0015 | 0.03 | 0.05 |
| Fixing Belt to Paper | | | | |
| Following Movement | Δ | Δ | X | X |
| Slower Rotation | ○ | ○ | Δ | X |
| Faster Rotation | Δ | ○ | ○ | X |
| Pressure Belt to Paper | | | | |
| Following Movement | X | X | X | X |
| Slower Rotation | X | X | X | X |
| Faster Rotation | ○ | ○ | ○ | ○ |

As apparent from the results shown in Table 3, a condition for not causing a slippage between the belts and the sheet is the condition in which the pressure belt 321 is driven at a peripheral speed higher than that of fixing belt 320 and the oil quantity is 0.03 mg/mm$^2$ or less.

The results of verifications on the occurrence of image displacements in the actual fixing apparatus X are shown below. Table 4 shows the results on whether an image displacement occurred or not when the peripheral speed of the pressure roller 326 was varied wherein the peripheral speed of the fixing roller 323 has a fixed value. The verifications were conducted under an environment of high temperature and humidity (at a temperature of 30° C. and a humidity of 80%) with a peripheral speed of the fixing roller 323 of 80 mm/s, a surface temperature of the fixing belt 320 of 190° C., and an oil quantity of 0.015 mg/mm$^2$.

TABLE 4

| Peripheral Speed of Separation Roller to that of Fixing Roller | Image Displacement |
|---|---|
| Following Movement | X |
| 0.95 | X |
| 0.97 | X |
| 1.02 | ○ |
| 1.05 | ○ |

TABLE 4-continued

| Peripheral Speed of Separation Roller to that of Fixing Roller | Image Displacement |
|---|---|
| 1.10 | ○ |
| 1.15 | ○ |

The results shown in Table 4 shows that image displacements can be prevented by performing driving such that the peripheral speed of the pressure roller 326 is higher than that of the fixing roller 323.

If the peripheral speed of the pressure roller 326 is higher than that of the fixing roller 323, the occurrence of image displacements can be prevented regardless of the magnitude of the difference in the peripheral speed.

If the peripheral speed of the pressure roller 326 is too high, a problem arises in which the durability is reduced by sliding and rubbing between the pressure belt 321 and the pressure roller 326. Therefore, it is desired that the peripheral speed of the pressure roller 326 be set so as not to exceed 1.2 times that of fixing roller 323.

In this exemplary embodiment, the relationship between the peripheral speed of the fixing roller 323 and the pressure roller 326 is shown when the thickness of the fixing belt 320 and that of the pressure belt 321 are substantially the same as each other and are sufficiently small relative to the diameter of the fixing roller 323 and that of the pressure roller 326.

However, in the case where one belt has a significantly larger thickness than that of the other belt, it is necessary to calculate the peripheral speed of the roller as (the radius of the driving roller+the thickness of the belt)×the rotation rate per unit time.

As a comparative example, when fixing operation was performed with the pressure pad 327 removed and in the absence of silicone oil, the pressure at the nip portion was insufficient, and image unevenness and insufficient gloss occurred.

As described above, in this exemplary embodiment, the occurrence of image unevenness and insufficient gloss caused by insufficient pressure in the nip is prevented by causing the belts to be pressed against each other by the pressure pad. Setting the peripheral speed of the pressure roller so as to be higher than that of the fixing roller can offer advantages described below. In the case where a sheet with a solid image formed over substantially the entire surface or a slippery sheet enters the nip portion, even when the speed of the sheet lags behind the speed of the outer surface of the fixing belt, the lag can be suppressed. In addition, applying an appropriate amount of lubricant to the pressure belt can prevent the occurrence of image displacements for any image pattern, sheet type, and environment.

Since the fixing apparatus according to this exemplary embodiment satisfies the conditions described above, the peripheral speed of the pressure roller is higher than that of the inner surface of the pressure belt in a state in which the fixing belt and the pressure belt are pressed into contact with each other (in a ready state to fix an image). In contrast, in a state in which the fixing belt and the pressure belt are separated from each other (in a standby state in which fixing operation is disabled), the peripheral speed of the pressure roller is substantially the same as that of the inner surface of the pressure belt, and the peripheral speed of the outer surface of the pressure belt is higher than that of the outer surface of the fixing belt (the peripheral speed of the fixing belt).

Third Exemplary Embodiment

The fundamental structure of the third exemplary embodiment is the same as that of the second exemplary embodiment except that the inner surface of the pressure belt is subjected to low friction treatment in place of the application of lubricant oil to the pressure belt in the second exemplary embodiment. The general structure of the device is substantially the same as that of the first exemplary embodiment.

Figure 12:
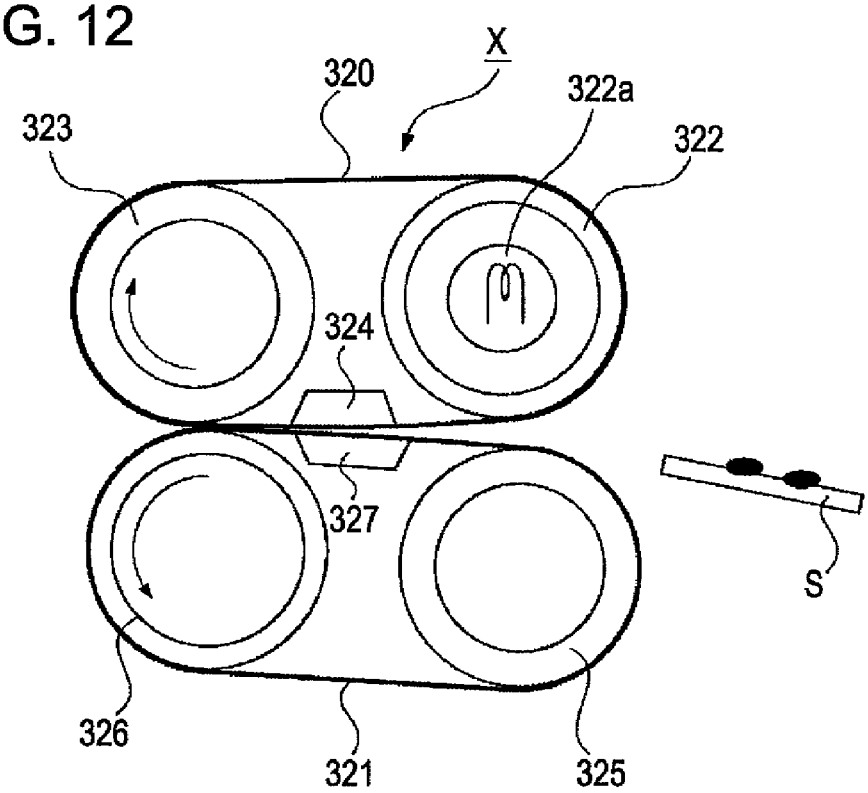
FIG. 12 is a cross-sectional view of the fixing apparatus according to a third exemplary embodiment.

As illustrated in FIG. 12, the inner face of the pressure belt 321 is coated with fluoroplastic, in place of the structure for applying silicone oil to the inner surface of the pressure belt.

If the friction force between the inner surface of the pressure belt 321 and each of the pressure roller 326 and the pressure pad 327 can be reduced, the surface of the pressure roller 326 and/or the surface of the pressure pad 327 can be subjected to fluoroplastic coating or diamond like carbon (DLC) coating.

Therefore, the occurrence of image displacements can be suppressed, as in the case of the second exemplary embodiment.

In the second and third exemplary embodiments, the pressure roller 326 is driven at a peripheral speed higher than that of the fixing roller 323 so that the pressure roller 326 slips on the pressure belt 321. Alternatively, even in a reversed structure, i.e., in a structure in which the fixing roller 323 is driven at a peripheral speed higher than that of the pressure roller 326 so that the fixing roller 323 slips on the fixing belt 320, the same advantages can be obtained.

Fourth Exemplary Embodiment

The fourth exemplary embodiment is described below. A major difference between the fourth exemplary embodiment and the first to third exemplary embodiments is in a separation roller that has a positive crowned shape, which will be described later.

In this exemplary embodiment, two examples are described as a fixing apparatus to which the present invention is applicable. First, the structure of each of the two fixing apparatuses is described. Thereafter, verifications in the two fixing apparatuses are described.

(Fixing Apparatus A)

Figure 14:
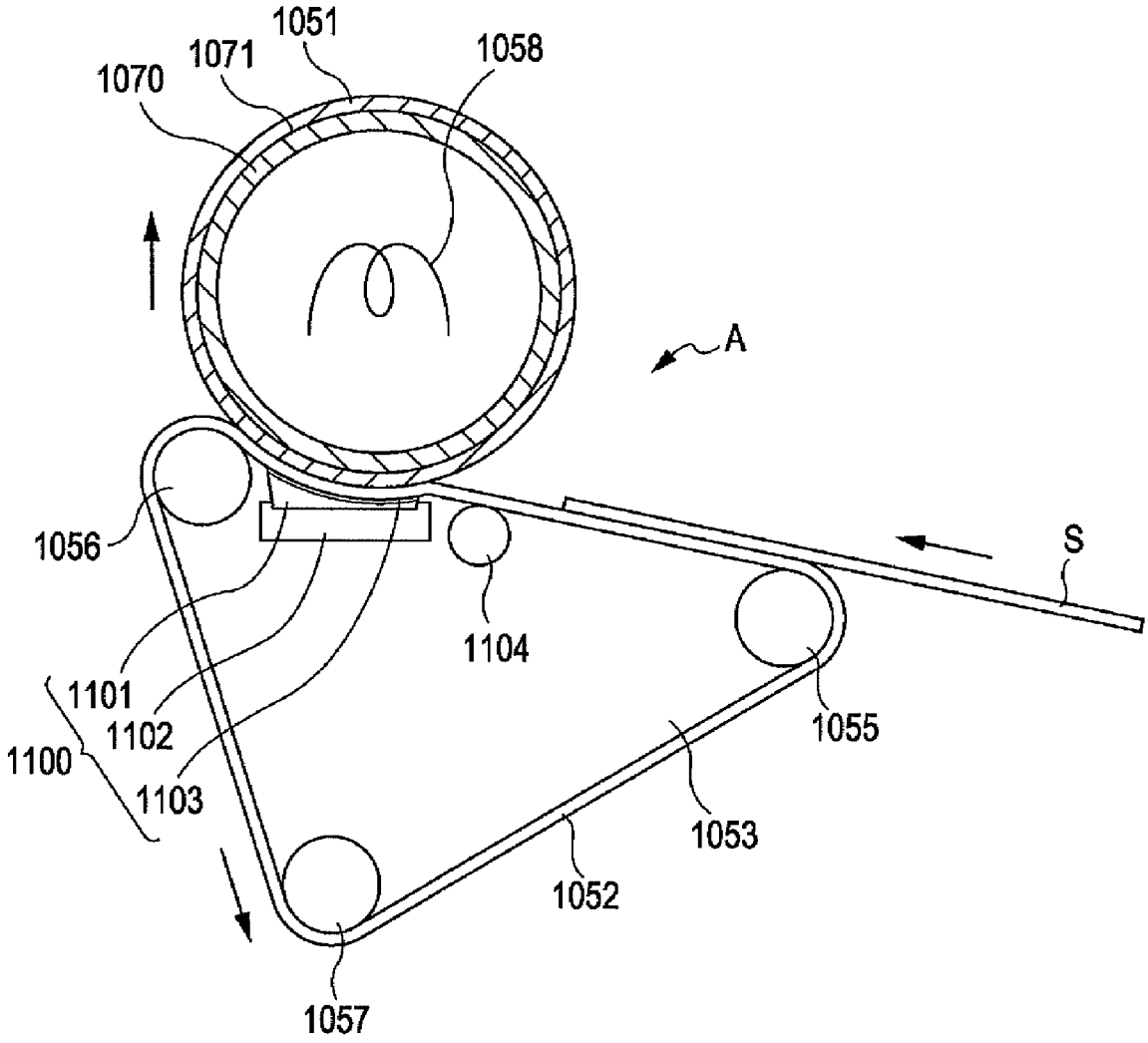
FIG. 14 illustrates a fixing apparatus according to the fourth exemplary embodiment, a known example, and a comparative example.

A fixing apparatus A is described below with reference to FIG. 14.

The fixing apparatus A includes a fixing roller 1051 and an endless belt 1052. The endless belt 1052 is stretched around a plurality of rollers 1055, 1056, and 1057 and is pressed toward the fixing roller 1051 by a pressure pad 1100.

The fixing roller 1051 includes a core metal formed from aluminum, iron and/or other known materials and an elastic layer formed from silicone rubber, fluorine rubber, or other known materials, the core metal being covered with the elastic layer. The fixing roller 1051 further includes a release layer formed from fluoroplastic disposed on the outer surface of the elastic layer. More specifically, the fixing roller 1051 has a straight shape in the longitudinal direction and an outer diameter of ϕ 40 mm and includes a core metal, a silicone rubber layer molded on the core metal, and a PFA tube covering the surface of the silicone rubber layer. The core metal is formed from iron and has an inner diameter of ϕ 37.8 mm, an outer diameter of ϕ 38.4 mm, and a thickness of 0.3 mm. The silicone rubber layer has a thickness of 0.5 mm, and the PFA tube has a thickness of 30 μm. The process speed (peripheral speed) of the fixing roller 1051 is 300 mm/sec. The peripheral speed of the separation roller 1056 is 310 mm/sec which is higher than that of the fixing roller 1051, which will be described later. A heater 1058 (e.g., halogen lamp) is disposed inside the fixing roller 1051. The fixing roller 1051 is connected to a thermistor (not shown) in a contact or noncontact manner. The surface temperature of the fixing roller 1051 is adjusted by controlling the voltage applied to the heater 1058 via a temperature adjustment circuit.

The fixing roller 1051 is provided with a cleaning apparatus (not shown). The cleaning apparatus cleans offset toner from the fixing roller 1051. An apparatus for applying a release agent can be used. In this case, the apparatus can apply silicone oil as the release agent to the fixing roller 1051, to facilitate the sheet S to be separated from the fixing roller 1051, and prevent toner from being offset. The endless belt 1052 includes a base formed from a resin (e.g., polyimide) or a metallic material (e.g., nickel) and an elastic layer formed from silicone rubber, fluorine rubber, or other known materials coating the base. More specifically, the endless belt 1052 is a seamless belt having an outer diameter of ϕ 90 mm in which a polyimide base layer with a thickness of 100 μm is coated with a silicone rubber layer with a thickness of 0.5 mm. A lubricant application apparatus 1104 for applying silicone oil as lubricant to the inner surface of the endless belt 1052 is disposed. The lubricant application apparatus 1104 can be a heat-resistant nonwoven fabric impregnated with the lubricant.

The pressure pad 1100 serving as a pressure applying member includes a stainless-steel base plate 1102 having a thickness of 5 mm, an elastic layer 1101 formed form silicone rubber with a hardness (Hs) of 30° disposed on the surface of the base plate 1102, and a low-friction layer 1103 formed from a glass cloth sheet with PTFE coating disposed on the elastic layer 1101. The pressure pad 1100 is pressed toward the fixing roller 1051 with a spring (not shown) disposed on the base plate 1102. In this exemplary embodiment, the pressure pad 1100 is pressed with a total pressure of N2=50 kg.

The separation roller 1056 is formed from a metallic material (e.g., stainless steel). More specifically, the separation roller 1056 is a solid stainless-steel roller, and performs pressing such that the endless belt 1052 is sandwiched between the fixing roller 1051 and the separation roller 1056. As a result, the elastic layer of the fixing roller 1051 can be deformed, thus allowing the sheet S to be easily separated from the fixing roller 1051. The separation roller 1056 performs pressing with a total pressure of 50 kg. Therefore, the total pressure pressed by the pressure pad 1100 and the separation roller 1056 is 100 kg. In this exemplary embodiment, the separation roller 1056 has an outer diameter of ϕ 15.5 mm at the central portion thereof in the longitudinal direction and an outer diameter of ϕ 15.0 mm at the ends thereof, so that the amount of a positive crowned portion is set to 500 μm, as will be described below.

The steering roller 1057 includes a core metal formed from a metallic material (e.g., stainless steel) and a high friction coefficient layer disposed on the core metal. The steering roller 1057 also functions to shake the endless belt 1052 in the width direction by causing a first end of the steering roller 1057 to be inclined in the longitudinal direction. The steering roller 1057 can also serve as a tension roller.

(Fixing Apparatus B)

Figure 16:
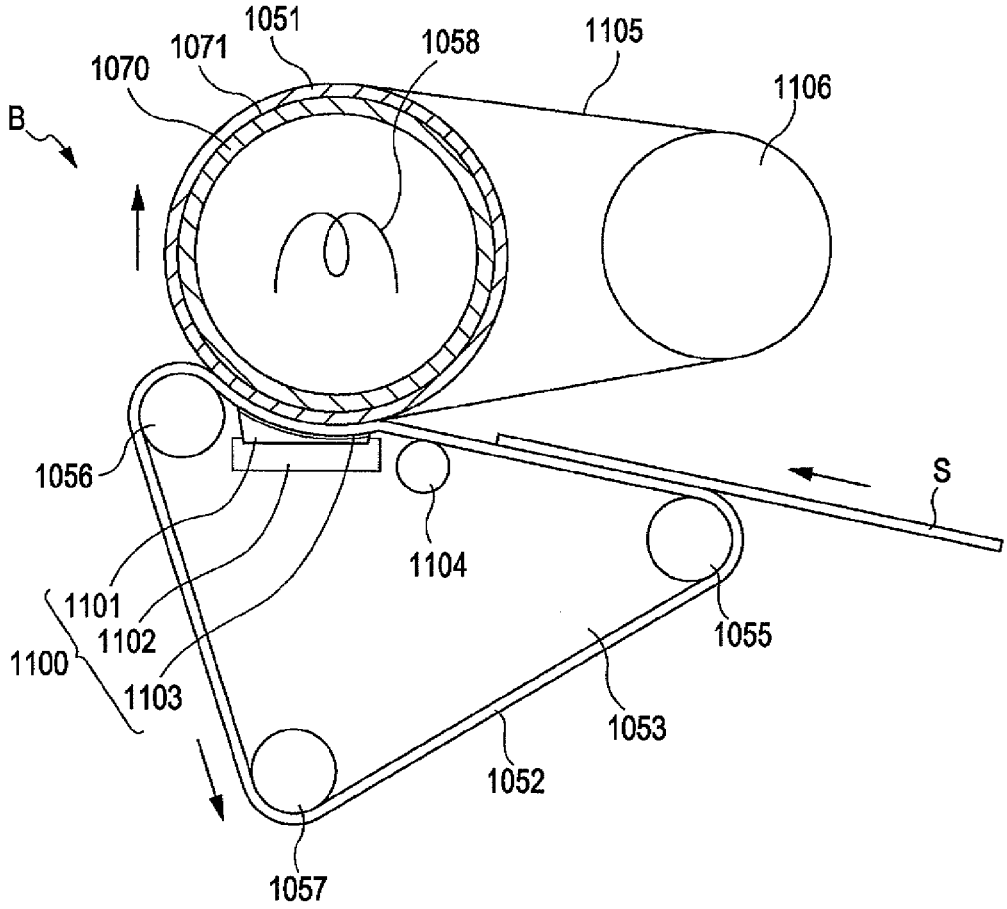
FIG. 16 illustrates another structure of the fixing apparatus according to the fourth exemplary embodiment.

A fixing apparatus B is described below with reference to FIG. 16. In the fixing apparatus B, the same reference numerals are used as in the fixing apparatus A for parts having similar functions, and the detailed description thereof is omitted.

The fixing apparatus B includes an endless belt 1105 utilizing the fixing roller 1051 as a suspension roller. The endless belt 1105 is substantially the same as the endless belt 1052. In this exemplary embodiment, the fixing roller 1051 has neither an elastic layer 1070 nor a resin layer 1071 and consists of a core metal.

(Verifications on Setting Conditions for Driving Fixing Apparatuses A and B)

Figure 15:
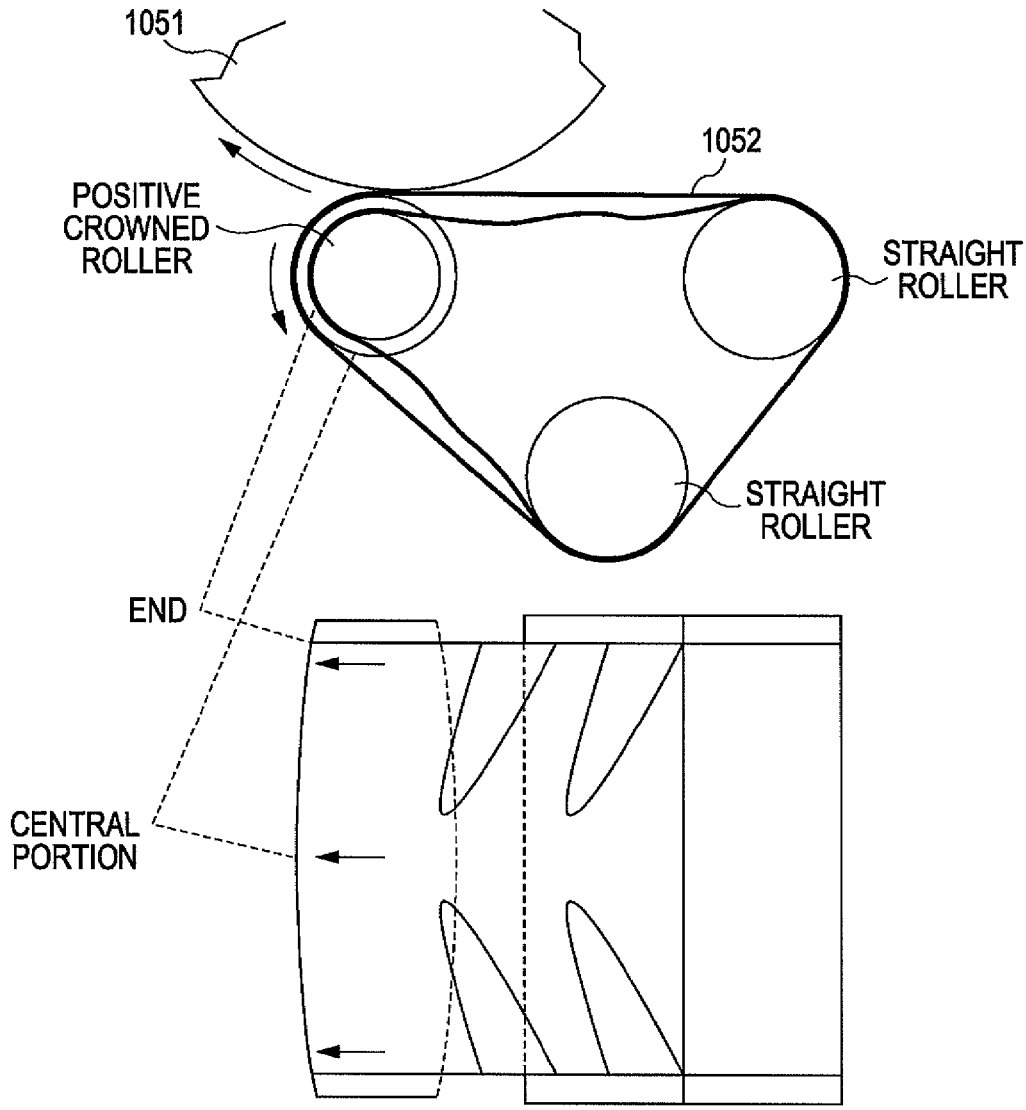
FIG. 15 illustrates how an endless belt waves.

In the first to third exemplary embodiments, the separation roller has a straight shape, which has the same diameter at any part in the axial direction. In this case, since the opposite ends of the separation roller in the axial direction are pressed toward the fixing roller, the nip shape formed by the separation roller which applies a pressure to the fixing roller via the endless belt is described below. That is, the nip width in the direction of conveying a recording medium is small by the amount of deflection at the central portion in the longitudinal direction and gradually increases as it approaches the opposite ends in the axial direction. In contrast, the separation roller 1056 in the fixing apparatuses A and B has a shape in which the diameter of the central portion in the axial direction is larger than that of the opposite ends in the axial direction, which is a so-called positive crowned shape. However, in the case of the separation roller 1056 having a positive crown shape, a deformation phenomenon in which the endless belt 1052 waves may occur, as illustrated in FIG. 15. When the endless belt 1052 waves, the sheet S is raised by the endless belt 1052, and an unfixed toner image may be distorted by the fixing roller 1051.

Setting conditions (friction coefficients) for driving according to this exemplary embodiment is described below with comparative examples. As the comparative examples, a fixing apparatus with the lubricant application apparatus removed, fixing apparatuses having a surface roughness Rz of the separation roller of 1 μm, 5 μm, and 10 μm, respectively, and a fixing apparatus with the low-friction layer 1103 removed were used.

Figure 13:
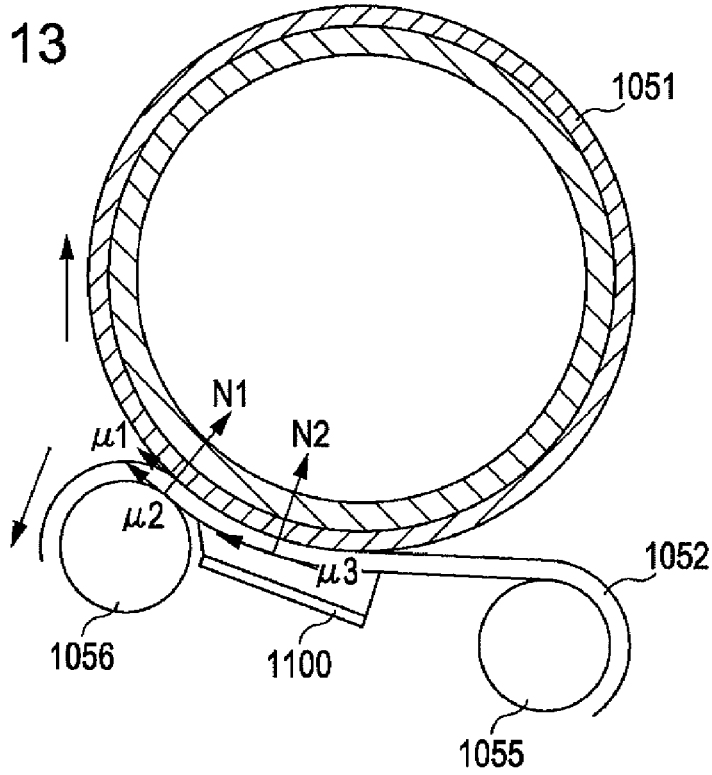
FIG. 13 illustrates the friction coefficients $\mu 1$, $\mu 2$, and $\mu 3$ according to a fourth exemplary embodiment.
Figure 17:
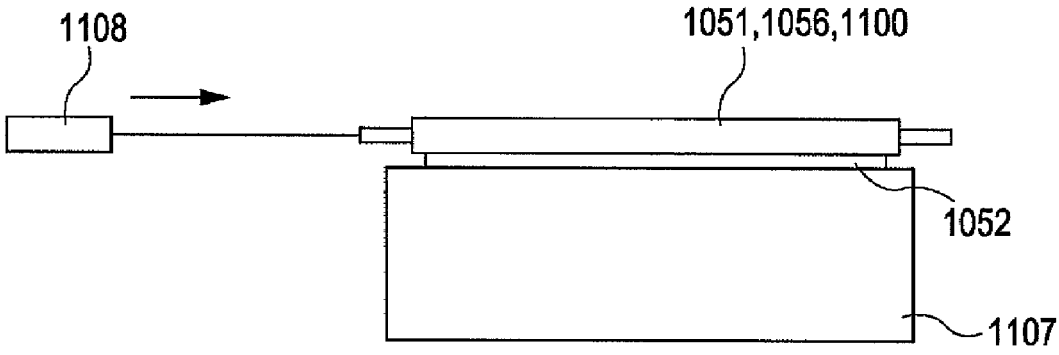
FIG. 17 illustrates a method for measuring the friction coefficient.
Figure 18A:
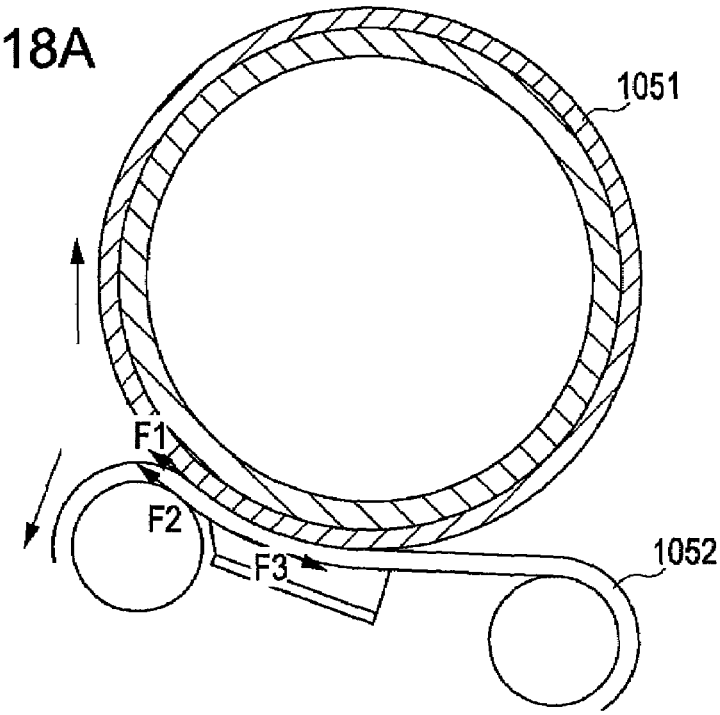
FIG. 18 illustrates the driving forces F1 and F2 of the endless belt and the brake force F3 of the endless belt.

As illustrated in FIG. 17, to measure the friction coefficient, the endless belt 1052 was cut open and placed on a hot plate 1107 whose temperature was adjusted at 170° C., and the fixing roller 1051, the separation roller 1056, or the pressure pad 1100 was placed on the endless belt 1052. In this state, a connected force gage 1108 was pulled in the direction of the arrow, the force when the sample started moving was read, the coefficient of kinetic friction was calculated, the force after the sample started moving was read, and the coefficient of kinetic friction was calculated. Cases in which the lubricant was applied and not applied between the endless belt 1052 and the separation roller 1056 or the pressure pad 1100 were measured. Unlike the first to third exemplary embodiments, in this exemplary embodiment, as illustrated in FIG. 13, the coefficient of kinetic friction between the surface of the fixing roller 1051 and the outer surface of the endless belt 1052 is defined as μ1. The coefficient of kinetic friction between the separation roller 1056 and the inner surface of the endless belt 1052 is defined as μ2 and the coefficient of kinetic friction between the pressure applying member and the inner surface of the endless belt 1052 is defined as μ3. Therefore, in this exemplary embodiment, F1, F2, and F3 are defined on the basis of the friction coefficients μ1, μ2, and μ3, the pressure of the separation roller 1056, N1, and the pressure of the pressure pad 1100, N2. As illustrated in FIG. 18A, the force with which the fixing roller 1051 drives the endless belt 1052 is defined as $F1=\mu1\cdot(N1+N2)$. The force with which the separation roller 1056 drives the endless belt 1052 is defined as $F2=\mu2\cdot N1$. The force with which the pressure pad 1100 aims to stop the endless belt 1052 by sliding and rubbing on the endless belt 1052 is defined as $F3=\mu3\cdot N2$.

Comparative experiments for the fixing apparatuses A and B were conducted under the conditions described below.

For the condition for fixation, the surface temperature of the fixing roller 1051 was controlled at 170° C. As the recording medium, a sheet of paper with a basis weight of 64 g/m$^2$, which was called plain paper, was used. A solid image (in which the maximum amount of toner was placed on the entire image-formable area) was formed over on the recording medium, and then was fixed.

Table 5 shows the results on the friction coefficients μ1, μ2, and 82 3 and the presence or absence of a wave phenomenon of the endless belt 1052, of a rub mark on the solid image, and of a belt slip.

TABLE 5

| | Exp.1 | Exp.2 | C.E1 | C.E2 | C.E3 | C.E4 | C.E5 | C.E6 | Exp.3 |
|---|---|---|---|---|---|---|---|---|---|
| Fixing Apparatus | | | | | A | | | | B |
| Low-friction Layer | | | Presence | | | | Absence | | Presence |
| Lubricant | | Presence | | | Absence | | Presence | Absence | Presence |
| Separation Roller Roughness Rz[μm] | 1 | 5 | 10 | 1 | 5 | 10 | 1 | 1 | 1 |
| μ1 | 0.3 | 0.3 | 0.3 | 0.3 | 0.3 | 0.3 | 0.3 | 0.3 | 0.3 |
| μ2 | 0.08 | 0.1 | 0.6 | 0.5 | 0.6 | 0.8 | 0.08 | 0.8 | 0.08 |
| μ3 | 0.05 | 0.05 | 0.05 | 0.1 | 0.1 | 0.1 | 0.55 | 0.7 | 0.05 |
| F1-F3 | 12.5 | 12.5 | 12.5 | 10 | 10 | 10 | −12.5 | −20 | 12.5 |
| F2 | 4 | 5 | 30 | 25 | 30 | 40 | 4 | 40 | 4 |
| Belt Wave/ Image Rub | ○ | ○ | X | Δ | X | X | — | — | ○ |
| Belt Slip | ○ | ○ | ○ | ○ | ○ | ○ | X | X | ○ |
| Determination | OK | OK | N | N | N | N | S | S | OK |

Exp. denotes Experiment.
C.E denotes Comparative Example.

For a belt waving phenomenon, ○ indicates that the belt waving did not occur; Δ indicates that the belt waving occurred slightly; and x indicates that the belt waving occurred. For a rub mark on an image, ○ indicates that the rub mark did not exhibit; Δ indicates that the rub mark exhibited slightly; and x indicates that the rub mark exhibited. For a belt slip, ○ indicates that the belt slip did not occur; Δ indicates that the belt slip occurred slightly; and x indicates that the belt slip occurred. In Table 5, "–" indicates that an image displacement caused by the belt slip occurred and the presence/absence of the belt wave and the rub mark on the image was unclear. In a determination section, "OK" indicates F1–F3>|F2|, "N" indicates F1–F3<F2, and "S" indicates F1–F3<–F2 (F1+F2<F3).

The results of comparative examples 5 and 6 in Table 5 show that the belt slip occurs when F1–F3<–F2 (determination: S). This is when F1+F2<F3 is satisfied in FIG. 18A and the driving force for the endless belt 1052 is lower than the brake force.

The results of experiments 1 and 2 and comparative examples 1 to 4 in Table 5 show that a smaller surface roughness of the separation roller 1056 is desired. The results of experiment 1 and comparative examples 2, 5, and 6 in Table 5 show that the application of the lubricant is desired and the provision of the low-friction layer 1103 to the pressure pad 1100 is desired. In this case, the belt wave and the image rub occur when F1–F3<F2 (determination: N). In other words, this is when F1<F2+F3 is satisfied in FIG. 18A and the fixing roller 1051 and the endless belt 1052 slip.

The experiments 1, 2, and 3 in Table 5 satisfy F1–F3>|F2| (determination: OK). In other words, F1–F3>F2 and F1–F3>–F2 are satisfied, and the belt slip and belt wave do not occur. The endless belt 1052 does not slip since F1+F2>F3 (F1–F3>–F2) is satisfied and thus the driving force from the fixing roller 1051 and the separation roller 1056 is larger than the brake force from the pressure pad 1100. In addition, since F1>F2+F3 (F1–F3>–F2) is satisfied, the driving force for the endless belt 1052 from the fixing roller 1051 is larger than the driving force of the inner surface of the endless belt 1052. Therefore, the speed of the endless belt 1052 follows the speed of the fixing roller 1051, and a difference in speed occurs in the longitudinal direction of the endless belt 1052 and the belt wave occurs, as described above.

Figure 18B:
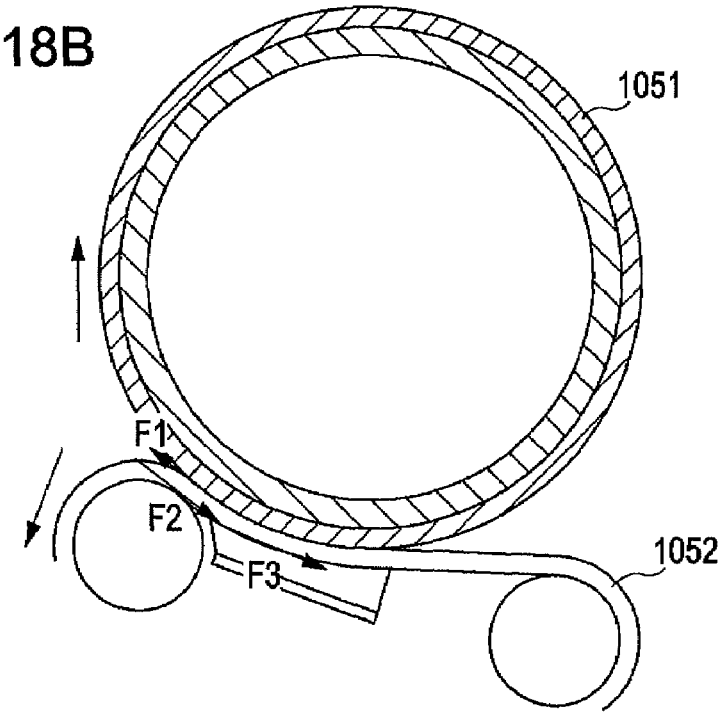

When the separation roller 1056 stopped rotatable driving and was rotated by following the endless belt 1052, a slippage occurred even for a case that no slippage occurred in Table 5. In addition, when the separation roller 1056 was rotatably driven and the peripheral speed thereof was less than 300 mm/sec, a slippage occurred. In this case, as illustrated in FIG. 18B, the driving force, F2, with which the separation roller 1056 drove the endless belt 1052 acted in the direction opposite to the direction in which the endless belt 1052 was rotated, and the driving force functioned as a brake force.

The results show that the separation roller 1056 has a different peripheral speed than that of the endless belt 1052 (slips) while at the same time supporting rotation driving for the endless belt 1052 by using kinetic friction.

As described above, when F1—F3>|F2| is satisfied, the slip and wave of the endless belt 1052 and the image rub can be prevented.

Facilitating the endless belt 1052 and the separation roller 1056 to slide is also advantageous to belt alignment control. When the steering roller 1057 functions as an alignment control roller, the steering roller 1057 angularly moves depending on the position of the endless belt 1052 in the longitudinal direction such that the endless belt 1052 is positioned in the center with respect to the longitudinal direction. In this case, the forces μ2 and μ3 act as a brake force to the force for alignment control by the steering roller 1057, facilitating the endless belt 1052 and the separation roller 1056 to slide. This causes an alignment control force to effectively act, and is thus advantageous for alignment control.

In this exemplary embodiment, three rollers are used to stretch the endless belt 1052 therearound. Alternatively, two rollers can be used, or only a separation roller and a pressure applying member can be used.

(Image Forming Device)

The general structure of an image forming device capable of incorporating the fixing apparatus A and the fixing apparatus B is now described with reference to FIG. 19.

Figure 19:
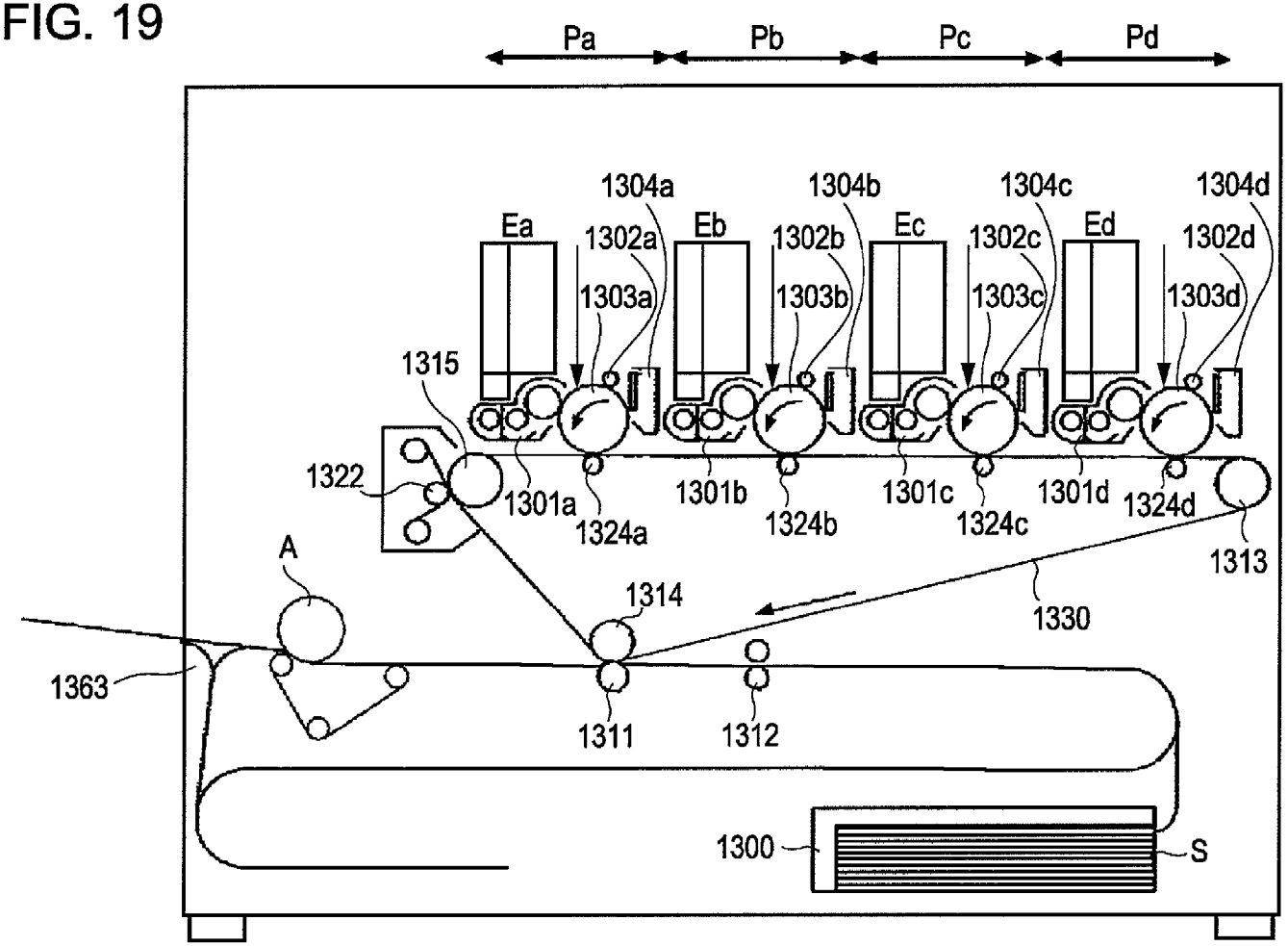
FIG. 19 illustrates a general structure of another image forming device.

Inside the device illustrated in FIG. 19, a first image forming subunit Pa, a second image forming subunit Pb, a third image forming subunit Pc, and a fourth image forming subunit Pd, all of which constitute an image forming unit, are disposed side by side and form toner images having different colors through a latent-image formation process, a development process, and a transfer process.

The image forming unit Pa, Pb, Pc, and Pd have the respective dedicated image carriers, i.e., in this exemplary embodiment, electrophotographic photoconductor drums 1303*a*, 1303*b*, 1303*c*, and 1303*d*, respectively. Toner images of different colors are formed on the photoconductor drums 1303*a*, 1303*b*, 1303*c*, and 1303*d*, respectively. An intermediate transfer member 1330 is disposed adjacent to the photoconductor drums 1303*a*, 1303*b*, 1303*c*, and 1303*d*. The toner images formed on the photoconductor drums 1303*a*, 1303*b*, 1303*c*, and 1303*d* are primarily transferred to the intermediate transfer member 1330, and are transferred to a sheet S at a secondary transfer unit. After the sheet S to which the toner image has been transferred is heated and pressed by the fixing apparatus A and the toner image is thus fixed, the sheet S is output as a recorded image to the outside of the device.

Drum chargers 1302*a*, 1302*b*, 1302*c*, and 1302*d*, developing units 1301*a*, 1301*b*, 1301*c*, and 1301*d*, primary transfer chargers 1324*a*, 1324*b*, 1324*c*, and 1324*d*, and cleaners 1304*a*, 1304*b*, 1304*c*, and 1304*d* are disposed around the photoconductor drums 1303*a*, 1303*b*, 1303*c*, and 1303*d*. In addition, a light source apparatus and a polygon mirror (not shown) are disposed in an upper part of the device.

A laser beam emitted from the light source apparatus is turned by the polygon mirror, and performs scanning. The scanning light beam is deflected by a reflection mirror, converged on bus bars on the photoconductor drums 1303*a* to 1303*d* by an fθ lens, and performs exposure. Therefore, latent images corresponding to image signals are formed on the photoconductor drums 1303*a*, 1303*b*, 1303*c*, and 1303*d*.

The developing units 1301*a* to 1301*d* are filled with predetermined amounts of yellow, magenta, cyan, and black toner as developers, respectively, by supply apparatuses (not shown). The developing units 1301*a* to 1301*d* develop the latent images on the photoconductor drums 1303*a* to 1303*d* and visualize them as yellow, magenta, cyan, and black images, respectively.

The intermediate transfer member 1330 is rotatably driven in the direction of the arrow at the same peripheral speed as that of the photoconductor drums 1303*a*, 1303*b*, 1303*c*, and 1303*d*.

The yellow toner image of a first color image formed and carried on the photoconductor drum 1303*a* passes through the nip formed by the photoconductor drum 1303*a* and the intermediate transfer member 1330. In this process, the yellow toner image is intermediately transferred to the outer surface of the intermediate transfer member 1330 by an electric field and pressure formed by a primary transfer bias applied by the transfer charger 1324*a*.

Similarly, the magenta toner image of a second color, the cyan toner image of a third color, and the black toner image of a fourth color are successively transferred on the intermediate transfer member 1330 such that the images are stacked on top of one another. Therefore, a combined color toner image corresponding to a target color image is formed.

A secondary transfer roller 1311 is disposed in contact with the lower surface of the intermediate transfer member 1330 so as to be borne in substantially parallel therewith. A desired secondary transfer bias is applied to the secondary transfer roller 1311 by a secondary transfer bias source. The combined color toner image transferred to the intermediate transfer member 1330 is transferred to the sheet S in the way described below. The sheet S sent from a feeding cassette 1300 passes through resist rollers 1312 and a before-transfer guide and then is conveyed to the nip where the intermediate transfer member 1330 and the secondary transfer roller 1311 are in contact with each other at a predetermined timing. At the same time, the secondary transfer bias is applied to the secondary transfer roller 1311 by the bias source. The combined color toner image is transferred from the intermediate transfer member 1330 to the sheet S by using the secondary transfer bias.

When the photoconductor drums 1303*a* to 1303*d* complete their respective primary transfers, toner remaining thereon is cleaned and removed by their respective cleaners 1304*a* to 1304*d*. Subsequently, the photoconductor drums 1303*a* to 1303*d* prepare for the next latent image formation. Toner and other foreign objects remaining on the intermediate transfer member 1330 are wiped off by causing a cleaning web (non-woven fabric) to come into contact with the surface of the intermediate transfer member 1330.

A transferred medium P to which the toner image has been transferred is successively introduced into the fixing apparatus A. In the fixing apparatus A, the toner image of the transferred medium is fixed by being heated and pressed, and the medium is then output to the outside through an ejection unit 1363.

In the exemplary embodiments, the fixing apparatus is used as the image heating apparatus. The present invention is applicable to a gloss application apparatus for increasing gloss level of a fixed image on a recording medium by heating the image again.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-265519 filed Sep. 13, 2005 and No. 2005-266009 filed Sep. 13, 2005, which are hereby incorporated by reference herein in their entirety.

What is claimed is:

1. A fixing apparatus comprising:

a heat rotation member and an endless belt configured to heat-fix an unfixed toner image on a recording medium at a nip therebetween, the heat rotation member being disposed so as to be in contact with the unfixed toner image at the nip;

a driving device configured to drive the heat rotation member to rotate; and a driving roller configured to drive the endless belt to rotate and to press the endless belt toward the heat rotation member, wherein the following expressions are satisfied:

$$\mu 2<\mu 1,$$

$$0.14<\mu 1,$$

$$0.005<\mu 2<0.3, \text{ and}$$

$$1<V2/V1<1.2,$$

where $\mu$1 is a friction coefficient between the heat rotation member and the endless belt, $\mu$2 is a friction coefficient between the endless belt and the driving roller, V1 is a peripheral speed of the heat rotation member, and V2 is a peripheral speed of the driving roller.

2. The fixing apparatus according to claim 1, wherein, when the heat rotation member and the endless belt are pressed into contact with each other, the peripheral speed V2 of the driving roller is higher than a peripheral speed of the endless belt, and the peripheral speed of the endless belt is substantially the same as the peripheral speed V1 of the heat rotation member, and wherein, when the heat rotation member is not in contact with the endless belt, the peripheral speed V2 of the driving roller is substantially the same as the peripheral speed of the endless belt.

3. The fixing apparatus according to claim 1, further comprising:

a pressing pad configured to press the endless belt toward the heat rotation member; and an applying device configured to apply a lubricant to an inner surface of the endless belt.

4. The fixing apparatus according to claim 1, wherein the heat rotation member includes a heating roller, and the driving device drives the heating roller to rotate, and wherein the friction coefficient $\mu$1 corresponds to a friction coefficient between the heating roller and the endless belt, and the peripheral speed V1 corresponds to a peripheral speed of the heating roller.

5. The fixing apparatus according to claim 1, wherein the heat rotation member includes an endless heating belt, and the driving device includes a belt driving roller configured to drive the endless heating belt to rotate and to press the endless heating belt toward the driving roller, and wherein the friction coefficient $\mu$1 corresponds to a friction coefficient between the endless heating belt and the endless belt, and the peripheral speed V1 corresponds to a peripheral speed of the endless heating belt.

6. The fixing apparatus according to claim 5, further comprising a pressing pad configured to press the endless belt toward the heat rotation member and a belt pressing pad configured to press the endless heating belt toward the pressing pad.

* * * * *